US012235062B2

(12) United States Patent
Kras

(10) Patent No.: US 12,235,062 B2
(45) Date of Patent: Feb. 25, 2025

(54) TOOLLESS SUPPRESSOR MOUNT

(71) Applicant: Sig Sauer, Inc., Newington, NH (US)

(72) Inventor: Krzysztof J. Kras, Fremont, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 18/337,879

(22) Filed: Jun. 20, 2023

(65) Prior Publication Data

US 2024/0077273 A1 Mar. 7, 2024

Related U.S. Application Data

(60) Provisional application No. 63/371,268, filed on Aug. 12, 2022.

(51) Int. Cl.
*F41A 21/32* (2006.01)
*F41A 21/30* (2006.01)
*F41A 21/34* (2006.01)

(52) U.S. Cl.
CPC ..... *F41A 21/325* (2013.01); *F41A 21/30* (2013.01); *F41A 21/34* (2013.01)

(58) Field of Classification Search
CPC ..... F41A 21/30; F41A 21/32; F41A 21/325; F41A 21/34; F41A 21/36; F41A 21/38
See application file for complete search history.

(56) References Cited

U.S. PATENT DOCUMENTS 5,773,746 A * 6/1998 Vaden ..... F41A 21/325 89/14.4
8,186,261 B2 5/2012 McNeill et al.
8,291,805 B1 * 10/2012 Quilligan ..... F41A 21/325 285/305
8,464,625 B2 6/2013 Polovnev et al.
8,490,535 B1 * 7/2013 Moore ..... F41A 21/34 42/1.06
8,499,676 B1 * 8/2013 Moore ..... F41A 21/325 89/14.4
9,513,078 B1 12/2016 Fulton et al.
9,709,354 B2 7/2017 Larue
9,921,021 B1 * 3/2018 Graham ..... F41A 21/325
9,927,201 B2 * 3/2018 Penchuk ..... F41A 21/325
9,958,227 B2 5/2018 Whitson
(Continued)

FOREIGN PATENT DOCUMENTS

WO WO-2019102510 A1 * 5/2019

*Primary Examiner* — Gabriel J. Klein
(74) *Attorney, Agent, or Firm* — Finch & Maloney PLLC

(57) ABSTRACT

A mounting assembly for firearm muzzle device includes an attachment mount extending along a central axis and having a proximal end portion and a distal end portion, the proximal end portion being configured to attach to a muzzle adapter or firearm muzzle, such as by threaded engagement. A locking mechanism on the mount proximal end portion includes cams received in openings defined in the mount proximal end portion, the cams movable between engaged position and disengaged positions. In the engaged position, the cams can engage an outer surface of a muzzle adapter installed in the attachment mount. A locking nut is rotatable about the mount proximal end portion and is configured so that rotating the locking nut in a first rotational direction moves the cams toward the engaged position and rotating the locking nut in a second rotational direction moves the cams towards the disengaged position.

17 Claims, 19 Drawing Sheets

(56) References Cited

U.S. PATENT DOCUMENTS

| | | | | |
|---|---|---|---|---|
| 10,082,355 | B2 * | 9/2018 | Addis | F41A 21/36 |
| 10,156,411 | B2 * | 12/2018 | Thompson | F41A 21/325 |
| 10,801,796 | B2 * | 10/2020 | Kras | F41A 21/325 |
| 11,156,423 | B2 | 10/2021 | Winterseth et al. | |
| 11,397,065 | B2 * | 7/2022 | Vanhatalo | F41A 21/325 |
| 2010/0229712 | A1 | 9/2010 | Graham | |
| 2014/0020977 | A1 * | 1/2014 | Shults | F41A 21/325<br>181/223 |
| 2014/0237881 | A1 * | 8/2014 | Mack | F41A 21/325<br>42/90 |
| 2018/0058791 | A1 | 3/2018 | Larue | |
| 2019/0353446 | A1 * | 11/2019 | Kras | F41A 21/325 |

* cited by examiner

TOOLLESS SUPPRESSOR MOUNT

RELATED APPLICATIONS

This application claims the benefit under 35 U.S.C. § 119(e) of U.S. Provisional Patent Application No. 63/371,268 titled TOOLLESS SUPPRESSOR MOUNT, and filed on Aug. 12, 2022, the contents of which are incorporated herein by reference in its entirety.

FIELD OF THE DISCLOSURE

This disclosure relates to muzzle accessories for firearms and more particularly to a mount for muzzle attachments, such as a suppressor.

BACKGROUND

The design of firearms and related accessories involves many non-trivial challenges. Some accessories are designed to be mounted to the muzzle-end of a firearm barrel in one or more particular rotational orientations to accomplish a desired effect. For example, a muzzle brake is an attachment that redirects a portion of propellant gases away from the bore axis as the gases escape from the barrel. When directed rearwardly, the gases push the firearm forward to partially counteract recoil forces from discharging the firearm. A muzzle brake is typically mounted to a firearm barrel in a particular rotational orientation to prevent gases from being directed upward into the line of sight of the firearm operator, or downward into the dirt or dust.

Suppressors are another muzzle accessory intended to reduce the audible report and the visible signature of the firearm. Some suppressors include a series of baffled chambers that slow down the expansion and the release of pressurized gases leaving the barrel, therefore reducing the audible and visible signature when discharging the firearm. The central opening through the suppressor must be sufficiently aligned with the bore axis to prevent a projectile from striking the suppressor and also to prevent reductions in accuracy. For this reason, the suppressor is generally attached securely to the barrel using a method that provides precision alignment with the bore axis.

SUMMARY

The present disclosure is directed to a mounting assembly for attaching a suppressor or other muzzle accessory to a firearm barrel. For example, the mounting assembly is configured as a toolless suppressor mount for use with a machine gun. In one such embodiment, the mounting assembly is configured to mount the suppressor or other device to a muzzle adapter on the barrel, where the mounting assembly includes a plurality of cams arranged to engage the outside surface of the muzzle adapter. The mounting assembly includes a mount that threadably engages threads on the outside of the muzzle adapter. When the cams are engaged (e.g., the mounting assembly is moved to a locking position), the cams engage the muzzle adapter to prevent loosening rotation of the mount that may otherwise result from vibration, recoil forces, and/or thermal cycling. The mounting assembly can be configured so that the user can remove and/or install the muzzle device without the need for tools.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1A:
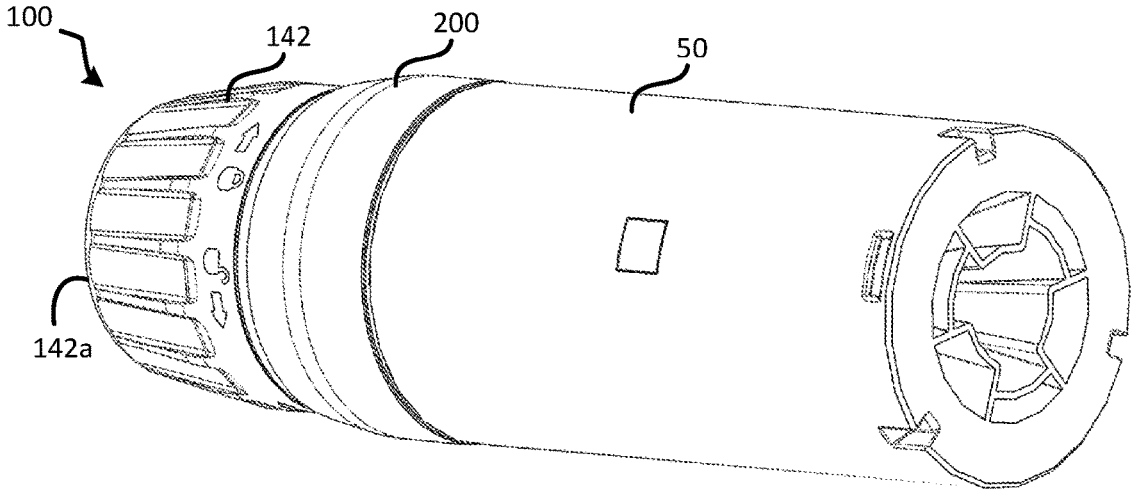
FIG. 1A illustrates a front perspective view of a mounting assembly and suppressor, in accordance with an embodiment of the present disclosure.

These and other features of the present embodiments will be better understood by reading the following detailed description, taken together with the Figures herein described. For purposes of clarity, not every component may be labeled in every drawing. Furthermore, as will be appreciated, the figures are not necessarily drawn to scale or intended to limit the present disclosure to the specific configurations shown. In short, the Figures are provided merely to show example structures.

DETAILED DESCRIPTION

A mounting assembly for a firearm muzzle attachment is disclosed. In accordance with one example embodiment, A mounting assembly includes an attachment mount extending along a central axis and having a proximal end portion and a distal end portion, the proximal end portion being configured to attach to a muzzle adapter or firearm muzzle, such as by threaded engagement. A locking mechanism on the mount proximal end portion includes cams received in openings defined in the mount proximal end portion. The cams are movable between an engaged position and a disengaged position. In the engaged position, the cams can engage an outer surface of a muzzle adapter or barrel installed in the attachment mount. A locking nut is rotatable about the mount proximal end portion and is configured so that rotating the locking nut in a first rotational direction moves the cams toward the engaged position and rotating the locking nut in a second rotational direction moves the cams towards the disengaged position. In some embodiments, a collar overlaps the locking nut and can be rotated to rotate the locking nut. By use of the locking mechanism, the mounting assembly enables toolless installation and removal of a suppressor or other muzzle device. The combination of threaded engagement and the cams engaging the outside of the muzzle adapter or barrel is used to prevent inadvertent loosening of the attachment mount due to recoil forces, vibration, and/or thermal cycling.

In one example, the muzzle adapter can be received in the proximal end of the attachment mount and secured by threaded engagement between the adapter's external threads and the mount's internal threads. In other embodiments, the muzzle adapter or barrel alternately can attach using a bayonet mount or twist-lock engagement. After installation, the locking nut on the mounting assembly can be rotated to the locked position, causing cams to engage the outside surface of the muzzle adapter or barrel. In the locked condition, the cams inhibit the attachment mount from rotating to a loosened position. The user can move the collar and locking nut to the unlocked position to disengage the cams and allow loosening of the threaded engagement. In some embodiments, a sealing taper between the muzzle adapter and the attachment mount can also be employed.

The muzzle adapter can be provided as a component of the mounting assembly or as a stand-alone part. In one embodiment, the muzzle adapter has a generally cylindrical body with a proximally located threaded portion and a cylindrical body portion that extends distally of the threaded portion and defines internal threads for attachment to a flash hider or other device. The distal end of the muzzle adapter includes a sealing taper configured to engage and form a seal with a corresponding taper on an inside of the attachment mount. The sealing taper on the muzzle adapter or on the attachment mount can be interrupted with a circumferential groove. In use, the circumferential groove functions to trap gas that leaks through small cracks in the seal that may form as the assembly heats up during use. Trapping leaking gases can reduce or eliminate brazing that may otherwise occur.

In one embodiment, the locking assembly includes an attachment mount that includes components of a locking assembly. For example, the locking assembly includes cams retained in openings defined in the proximal end portion of the attachment mount, where the cams are configured to engage the cylindrical body of the muzzle adapter when the locking assembly is in the locked position. Each cam is pivotably attached to a threaded body (e.g., a longitudinal "rack") that engages threads on the inside of the locking nut. Rotating the locking collar in the locking direction rotates the locking nut, which advances each threaded body axially and pivots the respective cam into engagement with the outside surface of the muzzle adapter. When the locking assembly is moved to the unlocked position, each threaded body advances axially in the opposite direction and pivots the cam out of engagement with the muzzle adapter to an extent sufficient to enable the user to unscrew the attachment mount from the muzzle adapter.

Optionally, a wire form is between the attachment mount and the locking nut and has portions protruding through the locking nut to engage the locking collar. The wire form provides tactile feedback to the user. For example, the wire form generally has a circular shape that is discontinuous and includes one or more protruding bends. An end of the wire form can be positioned to engage recesses or teeth around the outside of the attachment mount as the locking nut rotates to provide a "click" that can be heard and/or felt by the user when moving the locking collar to in a locking direction. A protruding bend can be received in one of several recesses in the locking collar to provide tactile feedback to the user when the collar is moved to the locking or unlocking positions. Numerous variations and embodiments will be apparent in light of the present disclosure.

General Overview

As noted above, non-trivial issues arise in the design of firearms and their accessories. For instance, a suppressor can be mounted to the muzzle of a firearm barrel. In some cases, the muzzle attachment can be secured to the barrel by direct threaded engagement with a threaded end of the barrel. In other cases, the muzzle attachment can be secured to the barrel using an adapter. For example, a muzzle adapter screws onto or is otherwise secured to a barrel. The muzzle adapter includes outer threads for engaging threads on the inside of a suppressor mount or the like.

It is desirable or required for muzzle attachments to resist changes in rotational or longitudinal position due to vibration, recoil forces, and thermal cycling. For example, a muzzle device installed when the firearm is cold may loosen during use due to differences in thermal expansion. A suppressor that loosens or becomes misaligned with the bore axis may result in the projectile striking the suppressor baffles, resulting in damage to the suppressor and possible injury to the operator or others nearby. Some muzzle devices also require being properly "timed" with the barrel, a goal that tends to conflict with the need to sufficiently tighten the device to the barrel to prevent loosening, both when cold and when the barrel is hot from use.

One approach of securing a muzzle accessory to an adapter or barrel has been to design mounts that use threaded engagement in combination with a sealing taper. For example, the muzzle adapter can have a shallow taper (e.g., 10° or less at each taper surface or 20°, inclusive) and the inside of the suppressor mount can have a corresponding taper. When the suppressor mount is threaded onto the muzzle adapter, the tapers engage to form a seal that can prevent inadvertent loosening of the threaded connection. However, when the threaded connection is tightened sufficiently to prevent loosening from vibration and recoil forces, tools often are necessary to break the taper seal between the mating surfaces. Additionally, when the assembly heats up during use, small leaks may form in the taper seal, allowing propellant gases to leak. In some cases, the propellant gases include copper and carbon that deposit on exposed surfaces and braze or otherwise make breaking the seal and removing the device very difficult, even with the use of tools.

An operator may need to remove the muzzle attachment for a variety of reasons, such as to repair or service the attachment, to clear an attachment that has become blocked with mud and vegetation, or to install a different attachment. Typically, a suppressor on a machine gun is heavy and bulky, so the suppressor is seldom or never removed from the barrel; instead, the barrel is changed together with the attached suppressor. However, recent demands require that a machine gun suppressor be removable from the barrel without tools.

Another approach to a toolless mounting assembly is one that relies on springs to lock and unlock the assembly. Although such assemblies can provide quick connection and disconnection when used on some firearms, the use of a spring or springs can be problematic when used with a machine gun. When the barrel and attachment become hot and remain hot from extended firing, the heat can cause the springs to soften and lose spring tension. The result is that the locking mechanism may fail to operate, defeating the goal of toolless assembly and removal.

Despite advancements in mounting assemblies for firearms, non-trivial challenges remain. The present disclosure addresses these and other needs by providing a toolless mounting assembly for muzzle devices, such as a suppressor.

While generally referred to herein as a mounting assembly for consistency and ease of understanding the present disclosure, the disclosed mounting assembly is not limited to that specific terminology and alternatively can be referred to, for example, as a mount, a suppressor mount, or other terms. As will be further appreciated, the particular configuration (e.g., materials, dimensions, etc.) of a mounting assembly configured as described herein may vary depending on the intended use. Numerous configurations will be apparent in light of this disclosure.

Structure and Operation

Figure 1B:
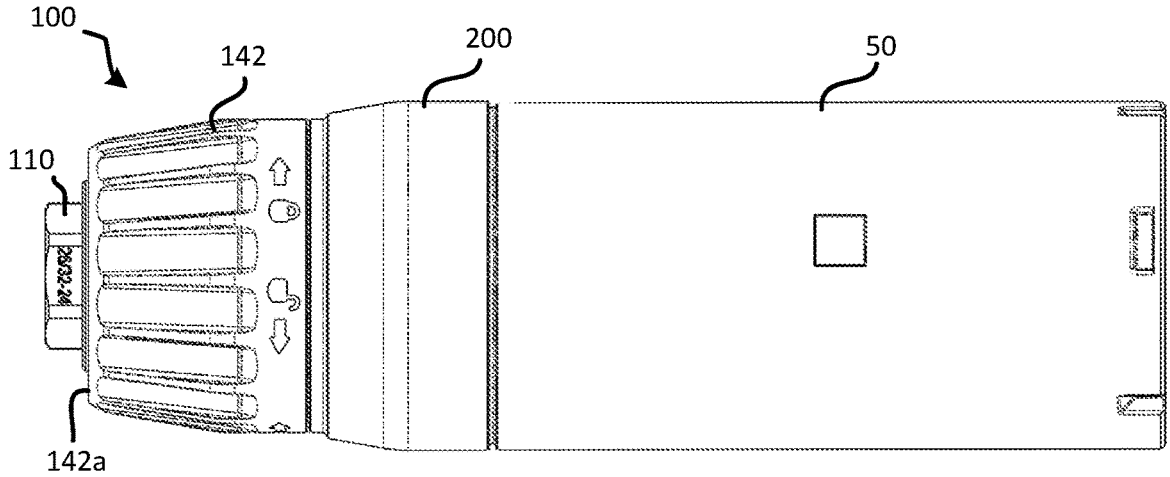
FIG. 1B illustrates a side view of the mounting assembly and suppressor of FIG. 1A.

FIGS. 1A-1B illustrate a mounting assembly 100 assembled with a suppressor 50, in accordance with an embodiment of the present disclosure, where FIG. 1A is a front perspective view and FIG. 1B is a side view. In this example, the mounting assembly 100 includes an attachment mount 200 coupled to the suppressor 50 via a threaded connection. In other embodiments, the attachment mount 200 can be welded or fixed to the suppressor 50 using other means. A locking collar 142 overlaps part of the attachment mount 200 and can be rotated to move a locking structure 160 between locked and unlocked positions. A proximal end of a muzzle adapter 110 protrudes from the proximal end 142*a* of the locking collar 142.

Figure 2A:
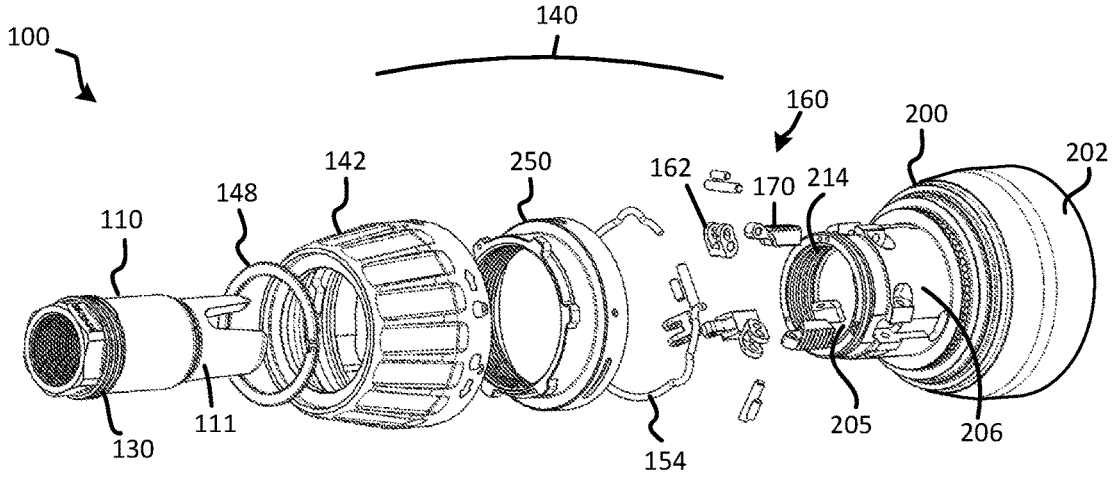
FIGS. 2A and 2B illustrate exploded rear and front perspective views, respectively, of components of a mounting assembly, a flash hider, and part of a suppressor, in accordance with an embodiment of the present disclosure.
Figure 2B:
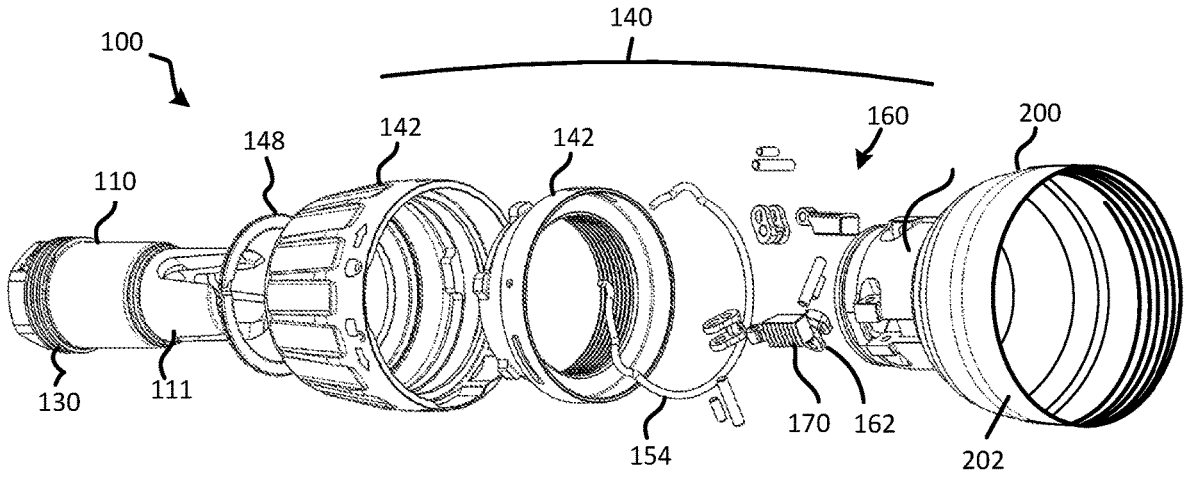

FIG. 2A illustrates an exploded rear perspective view and FIG. 2B illustrates an exploded front perspective view of a mounting assembly 100, in accordance with an embodiment of the present disclosure. In this example, the mounting assembly 100 includes a muzzle adapter 110 with attached flash hider 111, although the muzzle adapter 110 is a separate component in some embodiments. The mounting assembly 100 has an attachment mount 200 and a locking assembly 140. The attachment mount 200 has a distal end portion 204 configured to be secured to a muzzle attachment, such as a suppressor 50 (shown in FIGS. 1A-1B). In one example, the muzzle attachment can be screwed into the distal end portion 204 of the attachment mount 200. In other embodiments, the attachment mount 200 can be permanently attached to (e.g., by welding) or formed as a single piece with the muzzle attachment.

The attachment mount 200 is releasably attachable to the muzzle adapter 110 via threaded engagement between male threads 130 on the muzzle adapter 110 and female threads 214 in the mouth 205 of the attachment mount 200. The locking assembly 140 includes a locking collar 142 that can be installed over a locking nut 250. Rotating the locking collar 142 rotates the locking nut 250 and causes the locking structure 160 to engage or disengage the muzzle adapter 110. As shown, the locking structure 160 includes cams 162 and racks 170 retained on the proximal end portion 206 of the attachment mount 200. Threaded portions of the racks 170 engage threads on the inside of the locking nut 250 to advance or retract the racks 170 axially and cause the cams 162 to pivot into or out of engagement with the muzzle adapter 110. A retaining ring 148, such as a snap ring or split ring, can be installed on the proximal end portion 206 of the attachment mount 200 to retain the locking collar 142. A wire form 154 can be used with the locking collar 142 and locking nut 250 to provide tactile feedback to the user when moving the locking assembly 140 to the locked or unlocked positions. Components of the attachment mount 200 will be discussed in more detail below.

Figure 3A:
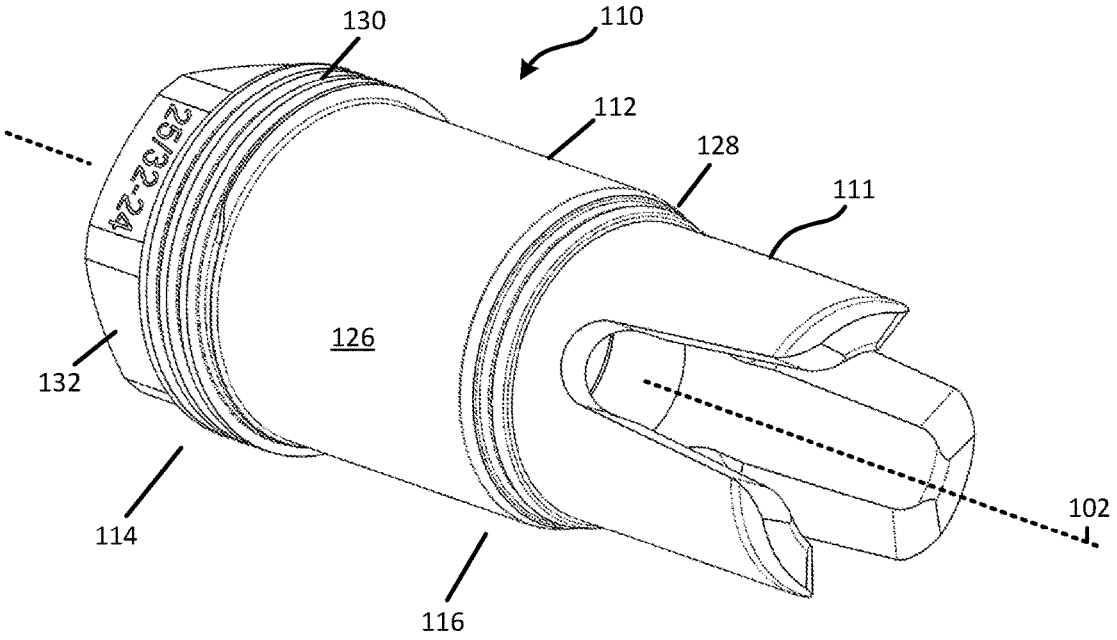
FIG. 3A illustrates a front perspective view of a flash hider assembled with a muzzle adapter, in accordance with an embodiment of the present disclosure.
Figure 3B:
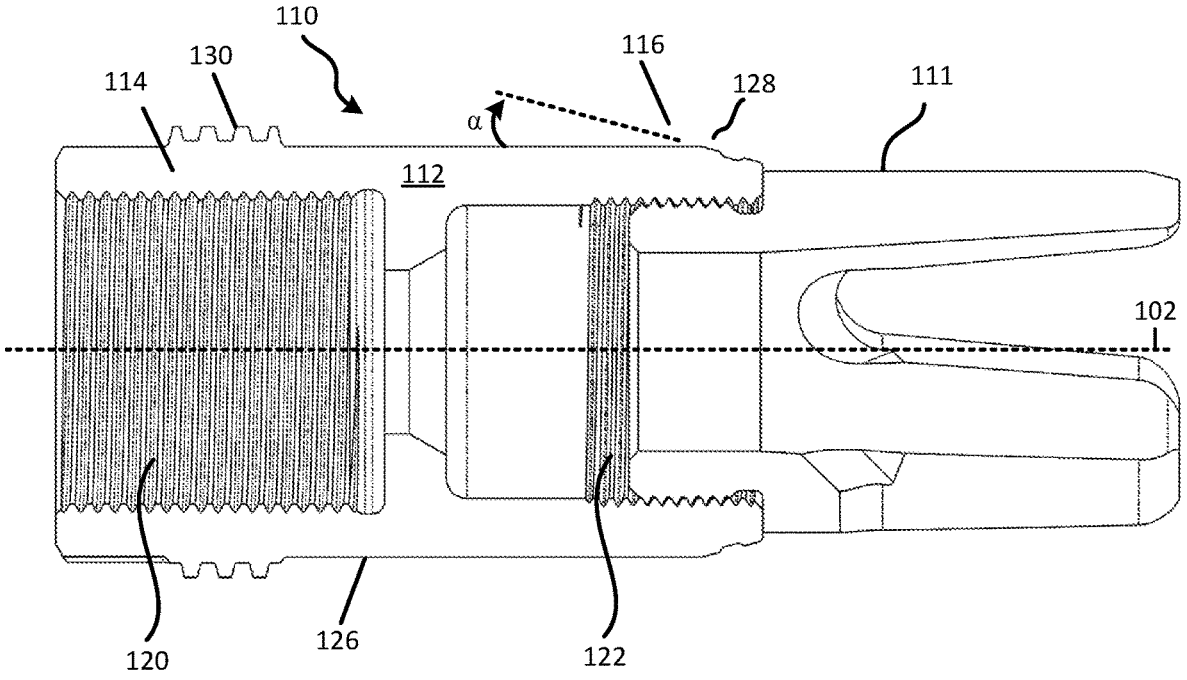
FIG. 3B is a side view of a longitudinal section of the flash hider and muzzle adapter of FIG. 3A.

Referring now to FIGS. 3A and 3B, a front perspective view and a side view showing a longitudinal section, respectively, show a muzzle adapter 110 with attached flash hider 111, in accordance with an embodiment of the present disclosure. The muzzle adapter 110 has an adapter body 112 with a proximal end portion 114 and a distal end portion 116. A central opening extends through the adapter body 112 along bore axis 102. The muzzle adapter 110 is configured to be attached to the muzzle-end of a firearm barrel. In some embodiments, such as shown, the muzzle adapter 110 has proximal or first female threads 120 in the proximal end portion 114. The first female threads 120 are configured to engage a corresponding male thread on the muzzle-end of a threaded barrel. For example, the female threads 120 are a 25/32-24 UNS thread or other suitable size and pitch, as will be appreciated. In some embodiments, the muzzle adapter 110 includes distal or second female threads 122 along the inside of the distal end portion 116, where the second female threads 122 are configured for threaded attachment to a muzzle device, such as flash hider 111.

In one embodiment, the adapter body 112 includes a sleeve portion 126 with a generally smooth, cylindrical outer surface. Optionally, the distal end portion 116 defines a taper 128. In some embodiments, the taper 128 defines a taper angle $\alpha$ greater than 7° with respect to the bore axis 102 (i.e., greater than 20° including opposite tapers), including at least 8°, 9°, 10°, 12°, 14°, 16°, 18°, or 20°, for example. It has been found that a taper angle $\alpha$ of about 15° or more facilitates alignment to and engagement with another corresponding tapered surface without forming a sealing interface that requires a tool to break the seal. A taper angle $\alpha$ of 7° or less generally results in a sealing interface that can be difficult to break without tools in some instances.

The proximal end portion 114 of the muzzle adapter 110 defines male threads 130 for threaded engagement with attachment mount 200. In some embodiments, the proximal end portion 114 defines wrench flats 132 to facilitate tightening the muzzle adapter 110 to the barrel of the host firearm. It is contemplated that the muzzle adapter 110 can be secured to the barrel using other removable or permanent methods, including a slip fit, an interference fit, welding, a bayonet mount, or a combination of these structures.

Figure 4A:
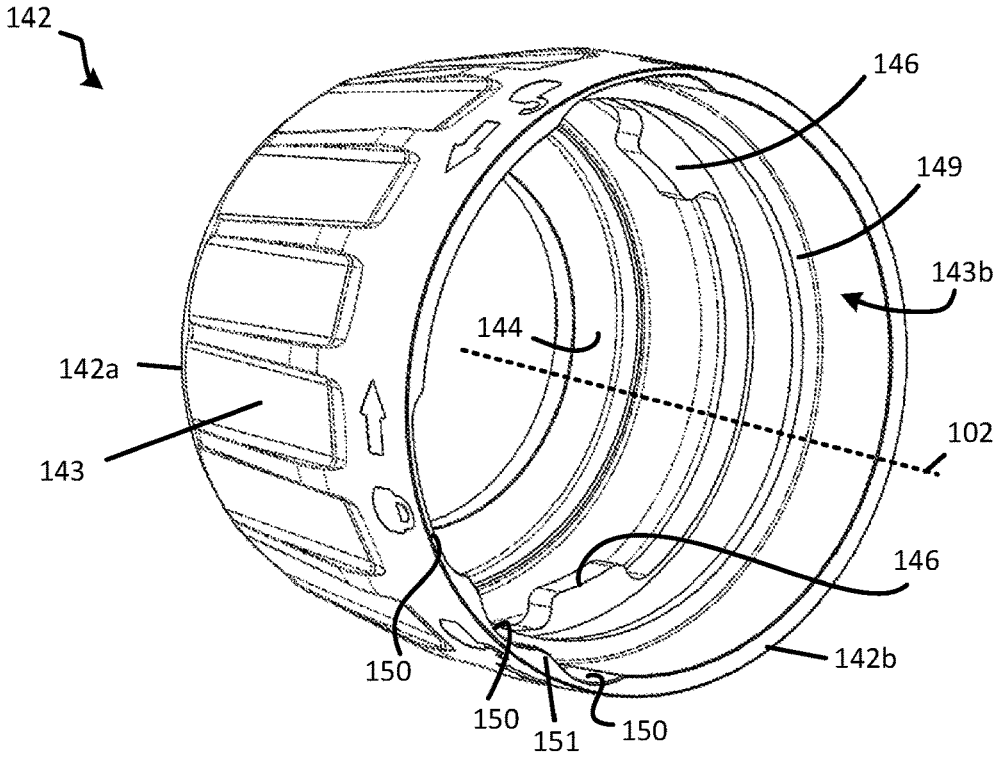
FIGS. 4A and 4B illustrate a front view and a front perspective view, respectively, of a locking collar, in accordance with an embodiment of the present disclosure.
Figure 4B:
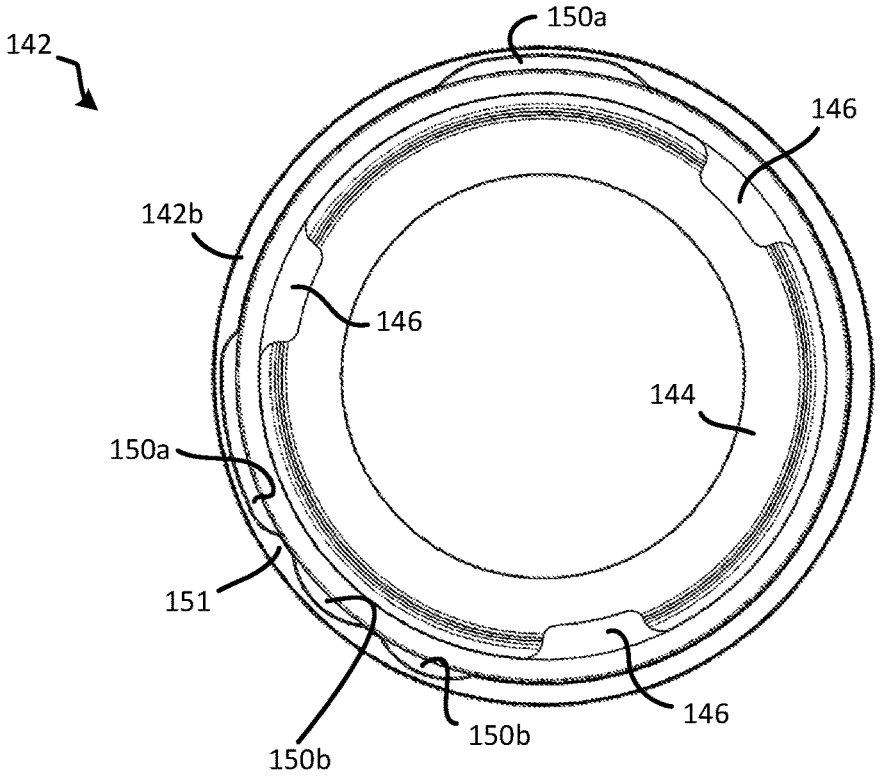

Referring now to FIGS. 4A and 4B, a front perspective view and a front view, respectively, illustrate a locking collar 142 in accordance with an embodiment of the present disclosure. The locking collar 142 generally has a cylindrical collar body 143 extending along the bore axis 102 from a proximal end 142*a* to a distal end 142*b*. The locking collar 142 is configured in some embodiments to overlap part of the attachment mount 200 and locking nut 250. For example, the collar body 143 overlaps and rotates about the mount proximal end portion 206 and can be retained by a retaining ring 148.

In some embodiments, the collar body 143 has an outside surface 143*a* that facilitates being gripped by a user. For example, the outside surface 143*a* includes a surface coating, grooves, knurling, or other feature suitable to facilitate rotation by the user in a variety of operating environments.

An inside 143*b* of the collar body 143 is configured to accommodate and operate with the locking structure 160. For example, the inside 143*b* defines one or more radial protrusions 146 that are positioned to engage a corresponding structure (e.g., a boss 260) on the locking nut 250. When the locking collar 142 rotates, one or more of the protrusions 146 contacts a boss 260 on the locking nut 250 to rotate the locking nut 250. As shown, the locking collar 142 includes three protrusions 146 that are distributed equally around the inside 143*b* of the locking collar 142. A circumferential rib 149 protrudes radially from the inside 143*b* of the locking collar 143 to provide a stop surface that can engage or abut the locking nut 250 when assembled.

The inside 143*b* defines one or more spring recesses 150 adjacent the distal end 142*b*. Note that some spring recesses 150 are elongated spring recesses 150*a* that are elongated circumferentially to accommodate rotational movement of part of the wire form 154, while other spring recesses 150 are small spring recesses 150*b* that are sized smaller and generally have an arcuate shape to receive an outward bend 155 on the wire form 154, discussed below. In some embodiments, the locking collar 142 can define a spring recess 150 for each of one or more desired positions of the locking collar 142, such as the locked or locking position and the unlocked or unlocking position. For example, each spring recess 150 can have a shape corresponding to that of the outward bend 155 of the wire form 154 (shown in FIG. 6). In each of the locked and unlocked positions of the locking collar 142, for example, the outward bend 155 occupies a respective one of the spring recesses 150. When the locking collar 142 is rotated, a ramp 151 between adjacent spring recesses 150 engages the outward bend 155 of the wire form 154 and compresses the spring radially inward towards the bore axis 102. After passing the ramp 151, the wire form 154 expands in a radially outward direction and the outward bend 155 again occupies one of the spring recesses 150. In some embodiments, the user may feel the wire form "snap" or settle into place when the locking collar 142 is moved to either the locked or the unlocked positions. In other embodiments, the locking collar 142 may define only one spring recess 150 corresponding to a preferred position of the locking collar 142 (e.g., the locked position). In yet other embodiments, the locking collar 142 defines more than two spring recesses 150, some or all of which can correspond to a particular position.

The locking collar 142 includes a proximal wall 144 with an annular shape that connects to collar body 143 at or near the proximal end 142*a*. The proximal wall 144 extends radially inward toward the bore axis 102. The proximal wall 144 may abut or be positioned closely adjacent a circumferential protrusion or rim 228 on the proximal end of the attachment mount 200 (shown, e.g., in FIGS. 10A-10D). In some embodiments, the retaining ring 148 is received in a circumferential groove 216 on the proximal end portion 206 of the attachment mount 200, where the retaining ring 148 retains the locking collar 142 on the attachment mount 200. For example, the retaining ring 148 is captured between the rim 228 on the attachment mount 200 and the proximal wall 144 of the locking collar 142 to prevent the locking collar 142 from moving proximally off of the attachment mount 200. Accordingly, removal of the retaining ring 148 would allow disassembly of the mounting assembly 100 for service or repair, as will be appreciated.

Figure 5A:
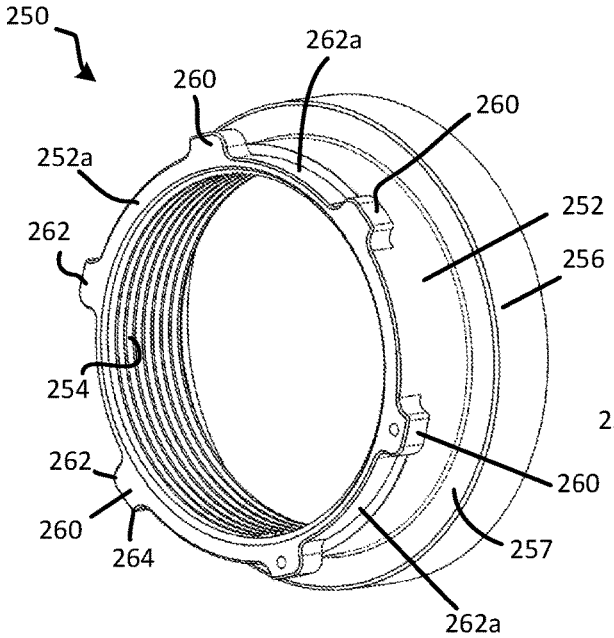
FIGS. 5A-5C illustrate a front perspective view, a rear perspective view, and a rear view, respectively, of a locking nut, in accordance with an embodiment of the present disclosure.
Figure 5B:
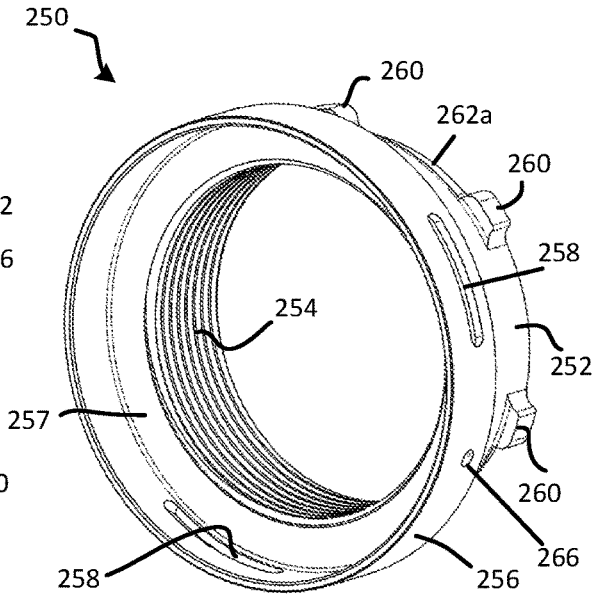
Figure 5C:
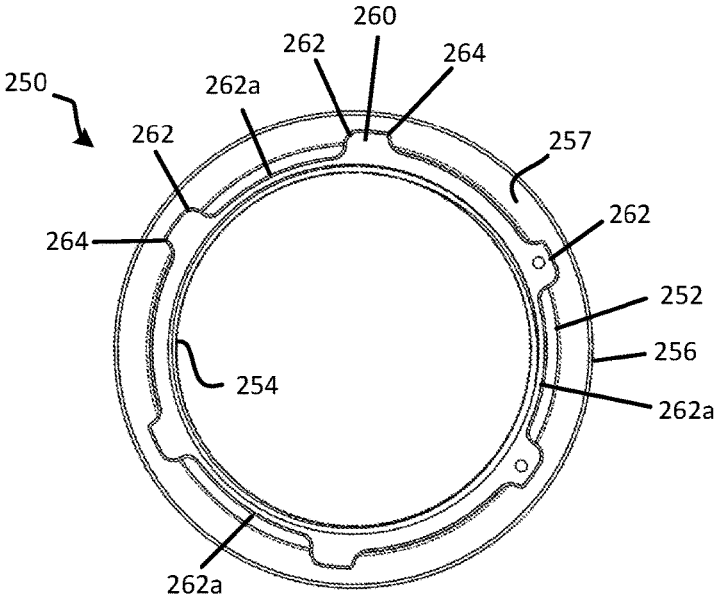

Referring now to FIGS. 5A-5C, a rear perspective view, a front perspective view, and a rear end view, respectively, show a locking nut 250, in accordance with an embodiment of the present disclosure. The locking nut 250 is configured to move the locking structure 160 between the engaged and disengaged positions when rotated about the proximal end portion 206 of the attachment mount 200. For example, threads 254 on the inside of the locking nut 250 engage threads on axially extending racks 170, causing the racks 170 to move axially when the locking nut 250 rotates.

The locking nut 250 generally has an annular geometry. A distal portion 256 has a greater diameter (inside and out) and defines one or more slot-like openings 258. The distal portion 256 defines one or more elongated openings 258 having a slot shape that extends circumferentially. As shown in FIG. 5B, for example, the distal portion 256 has two elongated openings 258, each of which is positioned adjacent the transition 257 to the smaller radius of the proximal portion 252. In its assembled form, the wire form 180 is received along the inside of the distal portion 256, with outward bends 182 protruding through the elongated openings 258. The distal portion 256 can also define an opening 266 for a first end 154*a* of the wire form 154.

A proximal portion 252 has a reduced diameter and defines threads 254 on the inside surface. The proximal portion 252 defines one or more bosses 260 that protrude radially outward. As shown, the proximal portion has six bosses 260 positioned at the proximal end 252*a*. In this example, the bosses 260 are distributed with substantially equal spacing about the circumference of the proximal portion 252. The bosses 260 are shaped to engage protrusions 146 on the inside of the locking collar 142 such that the locking collar 142 can be used to rotate the locking nut 250.

In some embodiments, each boss 260 has one rounded corner 262 and one square corner 264. Pairs of bosses 260 are arranged so that square corners 264 face towards one another circumferentially and rounded corners 262 face towards one another circumferentially; in other words, the position of the square corners 264 and rounded corners 262 on the bosses 260 alternate from one boss 260 to the next moving around the proximal portion 252, such as shown in FIG. 5C. Between rounded corners 262, the proximal portion 252 defines a circumferential recess 262*a*. In this example with six bosses 260, the proximal portion 252 has three circumferential recesses 262*a*. Adjacent the rounded corners and square corners 264, the bosses 260 transition to the proximal portion 252 with a curve or radiused transition. The particular geometry of bosses 260 described and shown is not required and other geometries can be used, such as a rectangular shape with square corners, a domed shape, or a trapezoidal shape. Numerous variations and embodiments will be apparent in light of the present disclosure.

When assembled, protrusions 146 on the inside of the locking collar 142 occupy the circumferential recesses 262*a*, which provide clearance between the protrusions 146 and the locking nut 250. The locking collar 142 can be rotated a portion of a revolution through a region of free play (e.g., about 60 degrees or less) so that protrusions 146 engage bosses 260 on the locking nut 250. In this condition, further rotation of the locking collar 142 in the same direction causes the locking nut 250 to rotate once the protrusions 146 rotate. Between locking and unlocking positions where the protrusions 146 engage the bosses 260, the locking collar 142 has a region of free play, where rotating the locking collar 142 has no rotating effect on the locking nut 250 since the protrusions 146 do not contact the bosses 260 for rotating the locking nut 250. In the locking position, the protrusions 146 engage one side of bosses 260 so that further rotation in a first direction moves the locking structure 160 to the locked position. In the unlocking position, protrusions 146 engage a second side of the bosses 260 so that further rotation in the opposite second direction moves the locking structure 160 to the unlocked position.

Figure 6:
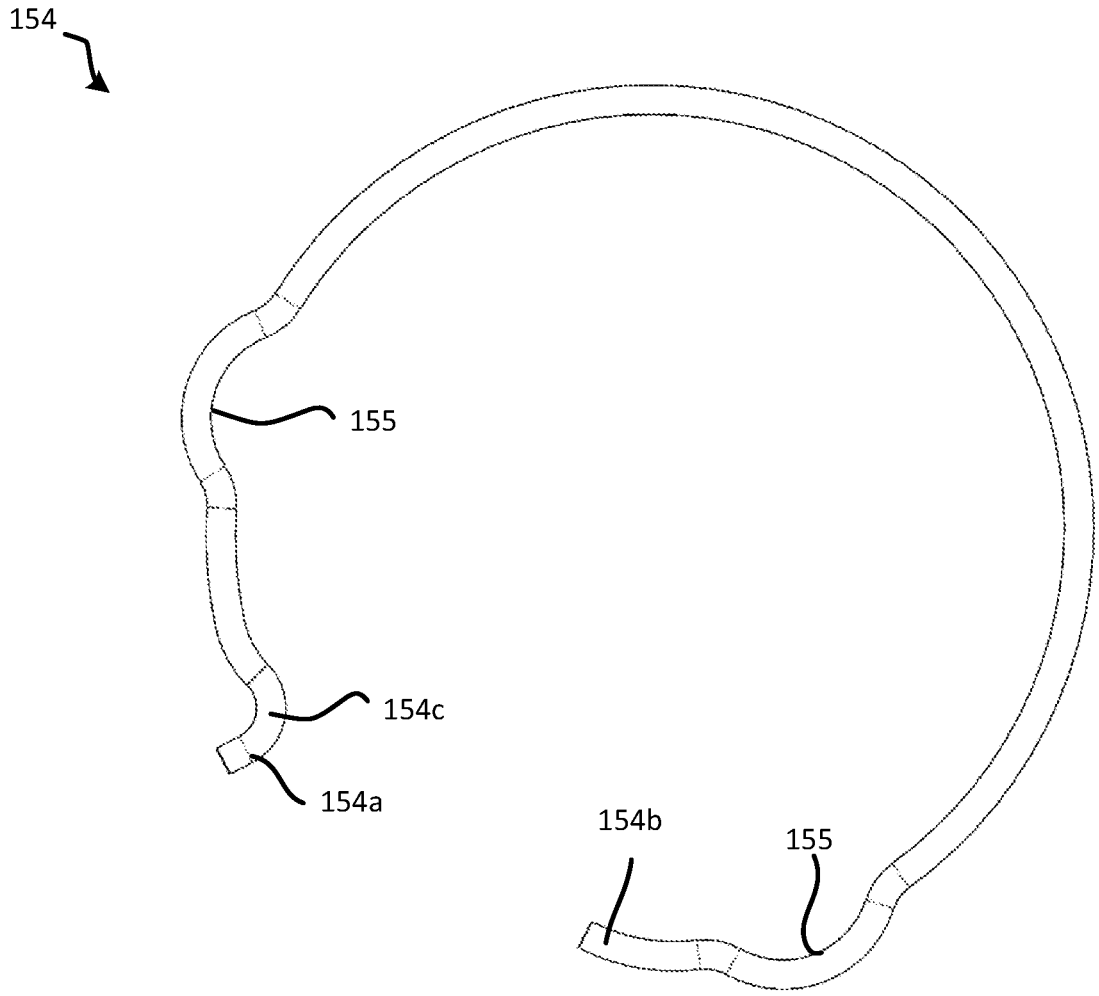
FIG. 6 illustrates a wire form used with the locking assembly, in accordance with an embodiment of the present disclosure.

FIG. 6 illustrates a plan view of a wire form 154 in accordance with an embodiment of the present disclosure. The wire form 154 extends from a first end 154*a* to a second end 154*b* along a generally circular path, where the first end 154*a* and second end 154*b* are discontinuous. The wire form 154 can be made from spring steel or other material with sufficient resiliency to return to a resting shape after being deformed during use. In some embodiments, the wire form 154 defines a bend 154*c* of about 90° adjacent the first end 154*a*, so that the first end 154*a* extends radially outward to define a catch or hook. The second end 154*b* is directed in a general circumferential direction and slightly radially inward. In use, the first end 154*a* can be installed through the opening 266 in the distal portion 256 of the locking nut 250 (shown in FIG. 5B) and received in a spring recess 150*a* along the inside of the locking collar 142.

The wire form 154 can be installed along the inside of the distal portion 256 of the locking nut 250 so that the wire form 154 is between the locking nut 250 and the attachment mount 200 and so that outward bends 155 protrude through elongated openings 258 of the locking nut 250 to be received in corresponding spring recesses 150 in the locking collar 142. In some embodiments, the second end 154*b* engages teeth or recesses 226 distributed around the outside of the attachment mount 200 as the locking nut 250 rotates. The wire form 154 is not required for operation of the mounting assembly 100, but it can be included to provide tactile feedback to the user during use. For example, outward bends 155 provide tactile feedback that the locking collar 142 has been moved to the locking or unlocking position. The second end 154*b* of the wire form 154 can provide clicking feedback when the locking assembly 140 is in being rotated in the locking direction about the attachment mount 200.

Figure 7A:
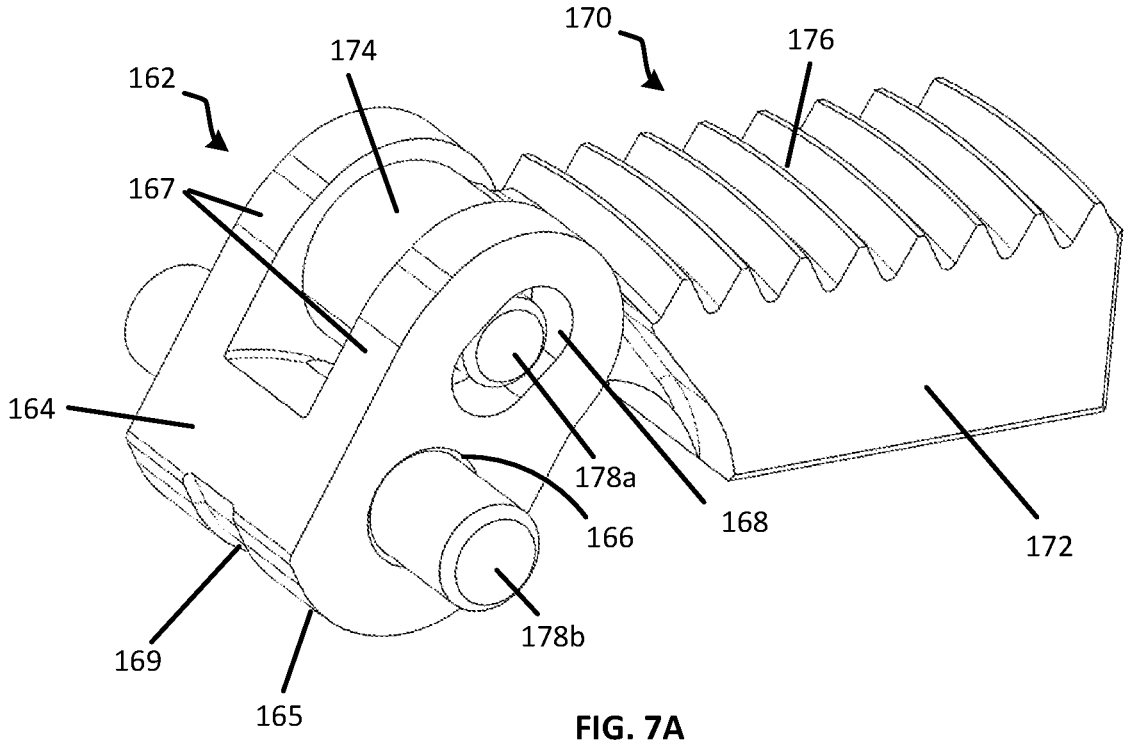
FIGS. 7A and 7B illustrate a perspective view and a side view, respectively, of a cam and rack assembly, in accordance with an embodiment of the present disclosure.
Figure 7B:
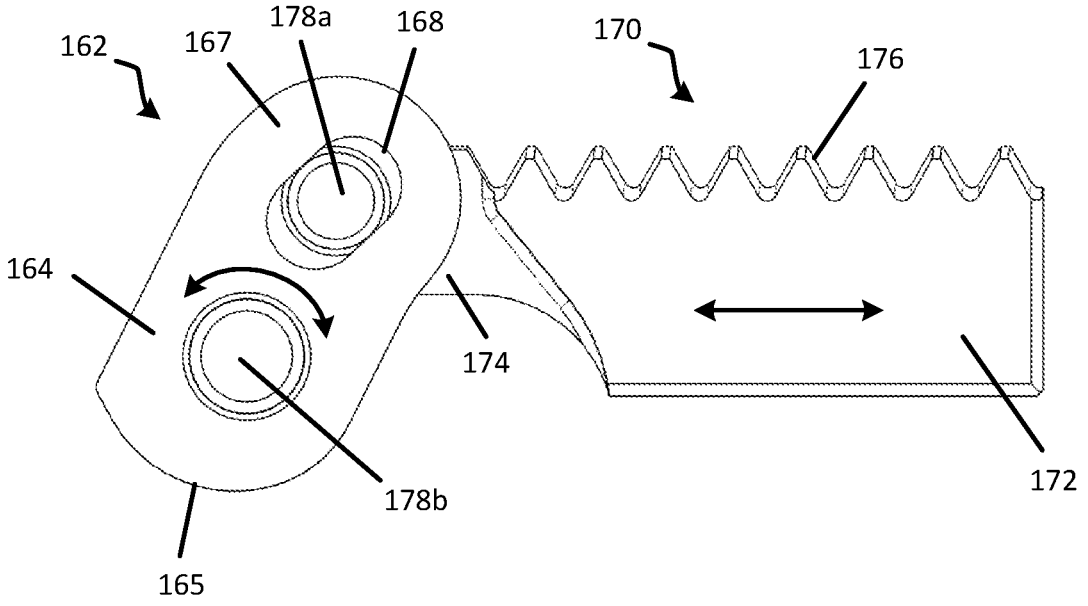
Figure 8A:
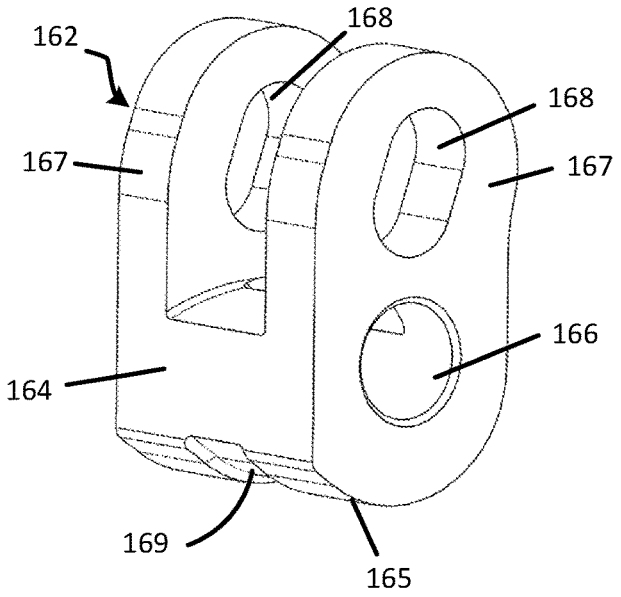
FIGS. 8A and 8B illustrate a perspective view and a side view of a cam shown in the assembly of FIGS. 7A and 7B, in accordance with an embodiment of the present disclosure.
Figure 8B:
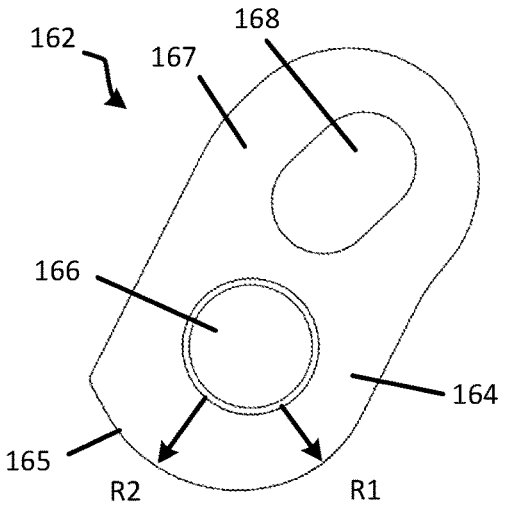
Figure 9A:
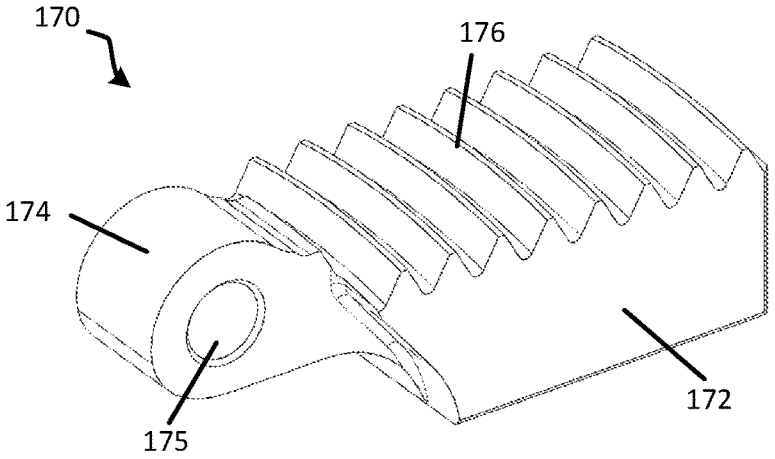
FIGS. 9A and 9B illustrate a perspective view and a side view, respectively, of a rack shown in the assembly of FIGS. 7A and 7B, in accordance with an embodiment of the present disclosure.
Figure 9B:
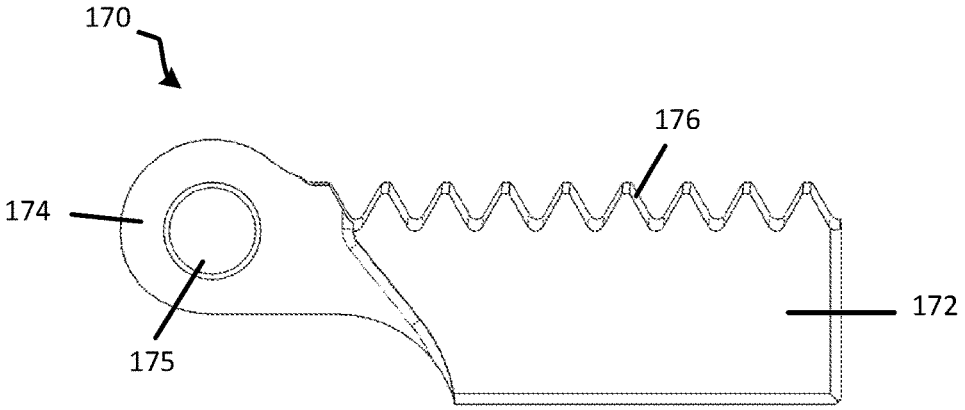

Referring now to FIGS. 7A-9B, components of a locking structure 160 are shown both in an assembled form and individually, in accordance with some embodiments of the present disclosure. FIG. 7A illustrates a perspective view of a cam 162 and a rack 170 in an assembled form and FIG. 7B shows a side view of the cam 162 and rack 170 of FIG. 7A. FIG. 8A illustrates a perspective view of a cam 162, FIG. 8B illustrates a side view of the cam 162, FIG. 9A illustrates a perspective view of a rack 170, and FIG. 9B illustrates a side view of the rack 170 of FIG. 9A. These figures are discussed concurrently below.

The cam 162 includes a cam body 164 that defines a pin opening 166 and has an arcuate cam surface 165. Optionally, the cam surface 165 is relieved with a groove 169 to improve engagement with the outside surface of the sleeve portion 126 of the muzzle adapter 110. One or more arms 167 attach to the cam body 164 opposite from the cam surface 165 and extend radially away from the cam body 164. Each arm 167 defines a pin slot 168. In the examples shown, the cam 162 includes two arms 167 that are spaced apart to receive a knuckle 174 on the rack 170. Alternately, the knuckle 174 of the rack 170 can define a slot and the arms 167 of the cam 162 can define a round opening for the second pin 178*b*, enabling pivoting movement of the cam 162 and axial movement of the rack 170.

The rack 170 includes a longitudinal rack body 172 connected to a knuckle 174 that defines a pin opening 175. In one embodiment, the rack body 172 has the shape of an elongated block with threads 176 on one side and a smooth opposite side. Threads 176 on the rack body 172 are sized and configured to engage the threads 254 on the inside of the locking nut 250 (shown in FIGS. 5A-5C). In the assembled form, the knuckle 174 is received between the arms 167 on the cam 162. The rack 170 can be connected to the cam 162 using a first pin 178*a* that extends through the pin opening 175 in the knuckle 174 and through the pin slot 168 in the arm(s) 167. A second pin 178*b* extends through the pin opening 166 in the cam body 164 and connects the cam 162 to the attachment mount 200. The pin slot 168 is elongated to enable the first pin 178*a* to maintain a fixed radial position with respect to the attachment mount 200 while the cam 162 rotates about the second pin 178*b* and while the rack 170 translates linearly along the attachment mount 200, such as indicated with arrows in FIG. 7B. Operation of the cam 162 and rack 170 are discussed in more detail below.

Figure 10A:
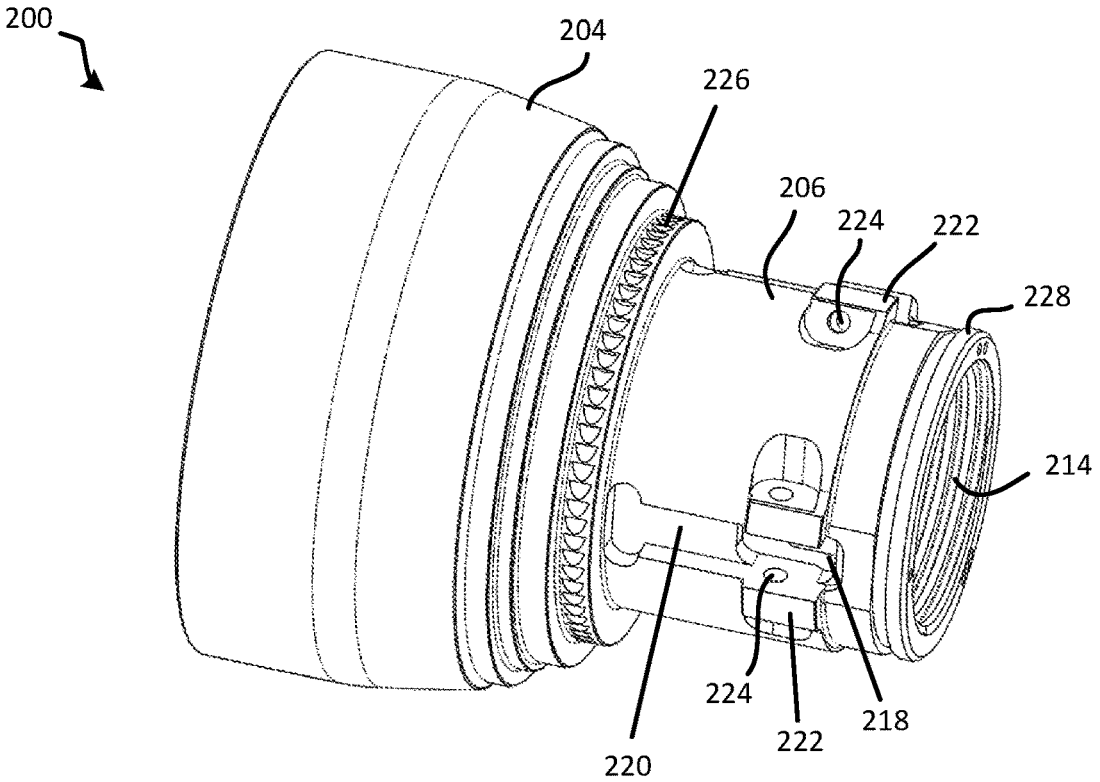
FIG. 10A illustrates a side and rear perspective view of an attachment mount, in accordance with an embodiment of the present disclosure.
Figure 10B:
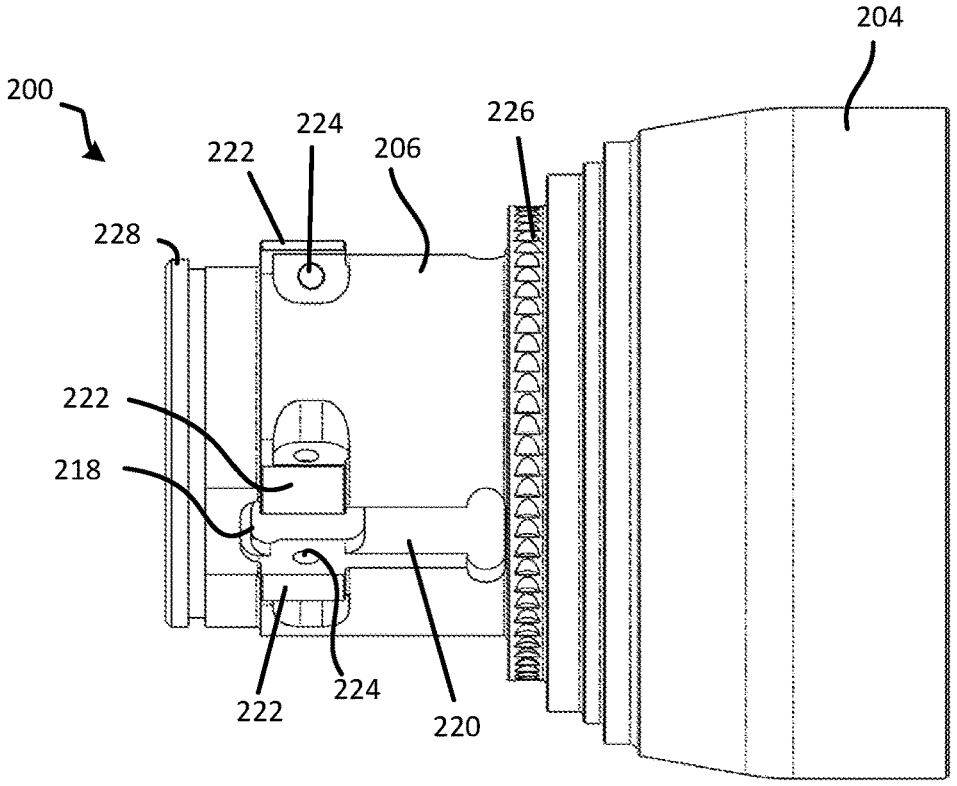
FIG. 10B illustrates a side view of the attachment mount of FIG. 10A.
Figure 10C:
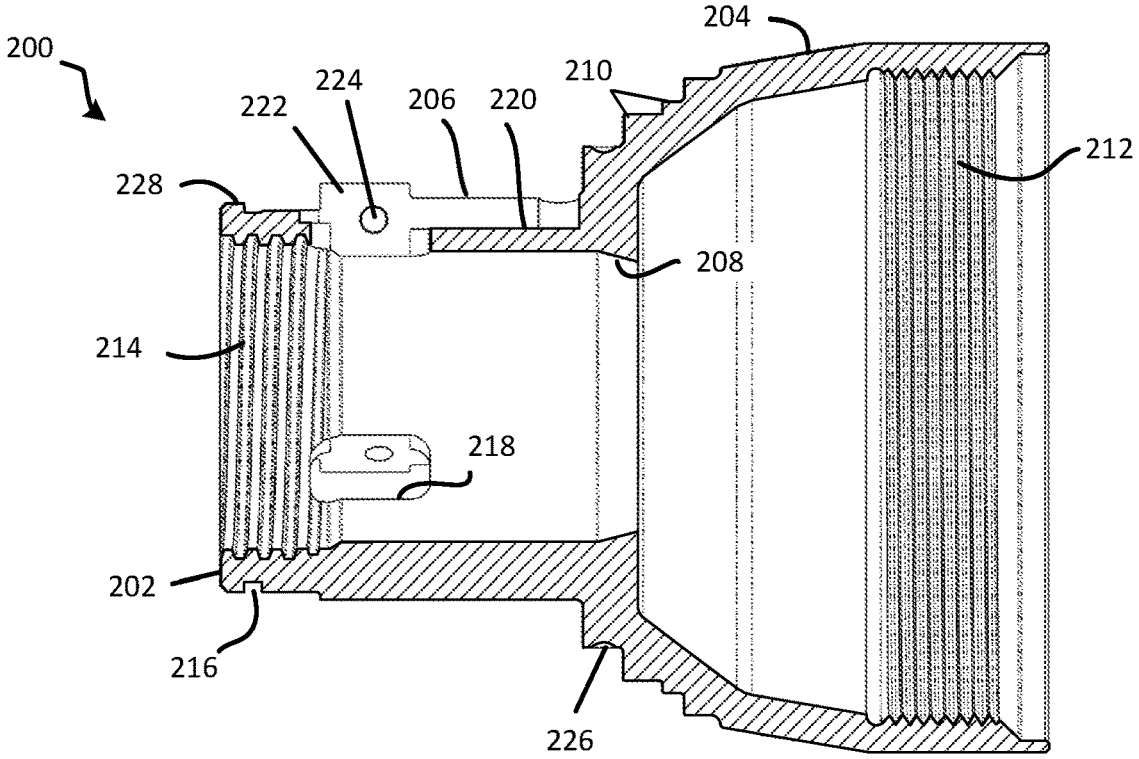
FIG. 10C illustrates a side view showing a longitudinal section of the attachment mount of FIG. 10A.
Figure 10D:
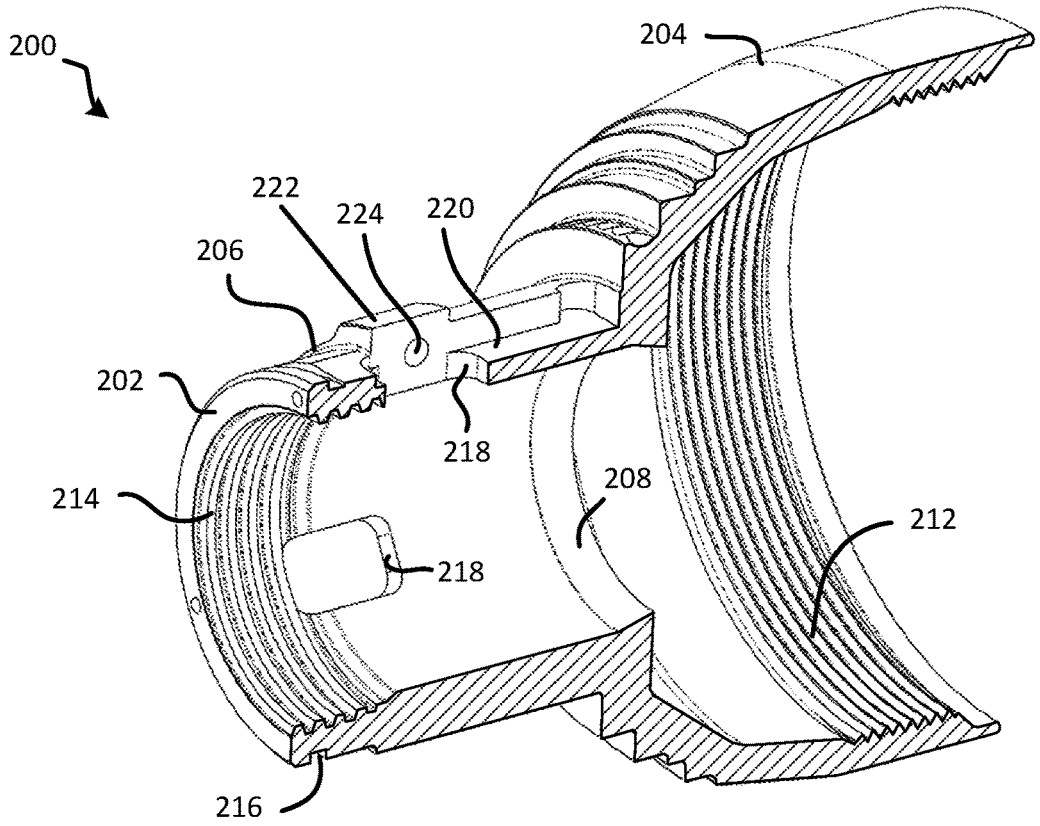
FIG. 10D illustrates a rear perspective view of the longitudinal section of FIG. 10C.

Referring now to FIGS. 10A-10D, various views illustrate an attachment mount 200, in accordance with an embodiment. FIG. 10A is a side and rear perspective view, FIG. 10B is a side view, FIG. 10C is a side view of a longitudinal section, and FIG. 10D is a rear perspective view of the longitudinal section of FIG. 10C. These figures are discussed concurrently below.

The attachment mount 200 has a distal end portion 204 configured for attachment to a suppressor (partially shown in FIG. 11A) and a proximal end portion 206 configured to retain components of the locking structure 160 and mount to a muzzle adapter or threaded firearm barrel. In this example, the distal end portion 204 is sized to attach to a suppressor 50 via threads 212. The distal end portion 204 is larger in diameter than the proximal end portion 206, which is sized to attach to a muzzle adapter 110 via threads 214. In this example, the distal end portion 204 increases in size from the cylindrical shape of the proximal end portion 206 with stepped increases in diameter. As also shown in FIG. 11B, for example, one of the steps 210 functions as a stop for the locking nut 250 and the same step 210 or another one of the steps 210 can be a stop for the locking collar 142. For example, each step 210 includes a radially extending portion and an axially extending portion. Part of the locking nut 250 or locking collar 142 overlaps and can rotate about the axially extending portion of the step 250. In one embodiment, an end of the locking nut 250 and end of the locking collar 142 each has a radial dimension approximately equal to that of the radially extending portion of the step 210.

The proximal end portion 206 can threadably engage the muzzle adapter 110 via female threads 214 and also defines a taper 208 configured to mate with and form a seal with the corresponding taper 128 on the muzzle adapter 110. The threads 214 are positioned in the mouth of the proximal end portion 206. The taper 208 is at the opposite end of the proximal end portion adjacent the distal end portion 204 or about the middle of the attachment mount 200, in some embodiments. After installation on the muzzle adapter 110 or barrel, the attachment mount 200 can be secured using the locking structure 160 (shown, e.g., in FIG. 11A), which includes cams 162 arranged to engage the muzzle adapter 110 when the locking assembly 140 is in the locked position.

The proximal end portion 206 has a generally cylindrical geometry and defines a circumferential groove 216 in the outside surface adjacent the proximal end 202. The circumferential groove 216 is configured to receive a retaining ring 148 (shown in FIG. 11A, for example) to retain the locking collar 142 on the attachment mount 200. The proximal end portion defines a plurality of rack recesses 220 extending longitudinally. Each rack recess 220 is sized to receive one of the racks 170 and permit axial movement of the rack 170. A cam opening 218 intersects each rack recess 220. A boss 222 is adjacent the cam opening 218 and defines a pin opening 224 sized to receive the second pin 178*b* of the locking structure 160 (shown in FIGS. 7A-7B), thereby retaining the cam 162 and rack 170 on the attachment mount 200.

The attachment mount 200 defines a plurality of teeth or recesses 226 distributed around the outside surface. The recesses 226 are configured to engage the second end 154*b* of the wire form 154 when the locking nut 250 rotates about the proximal end portion 206 towards the locked position. In this example, the recesses 226 are distributed circumferentially around the attachment mount 200 at a location between the proximal end portion 206 and the distal end portion 204 so that the wire form 154 aligns with the recesses 226 in the assembled state.

Figure 11A:
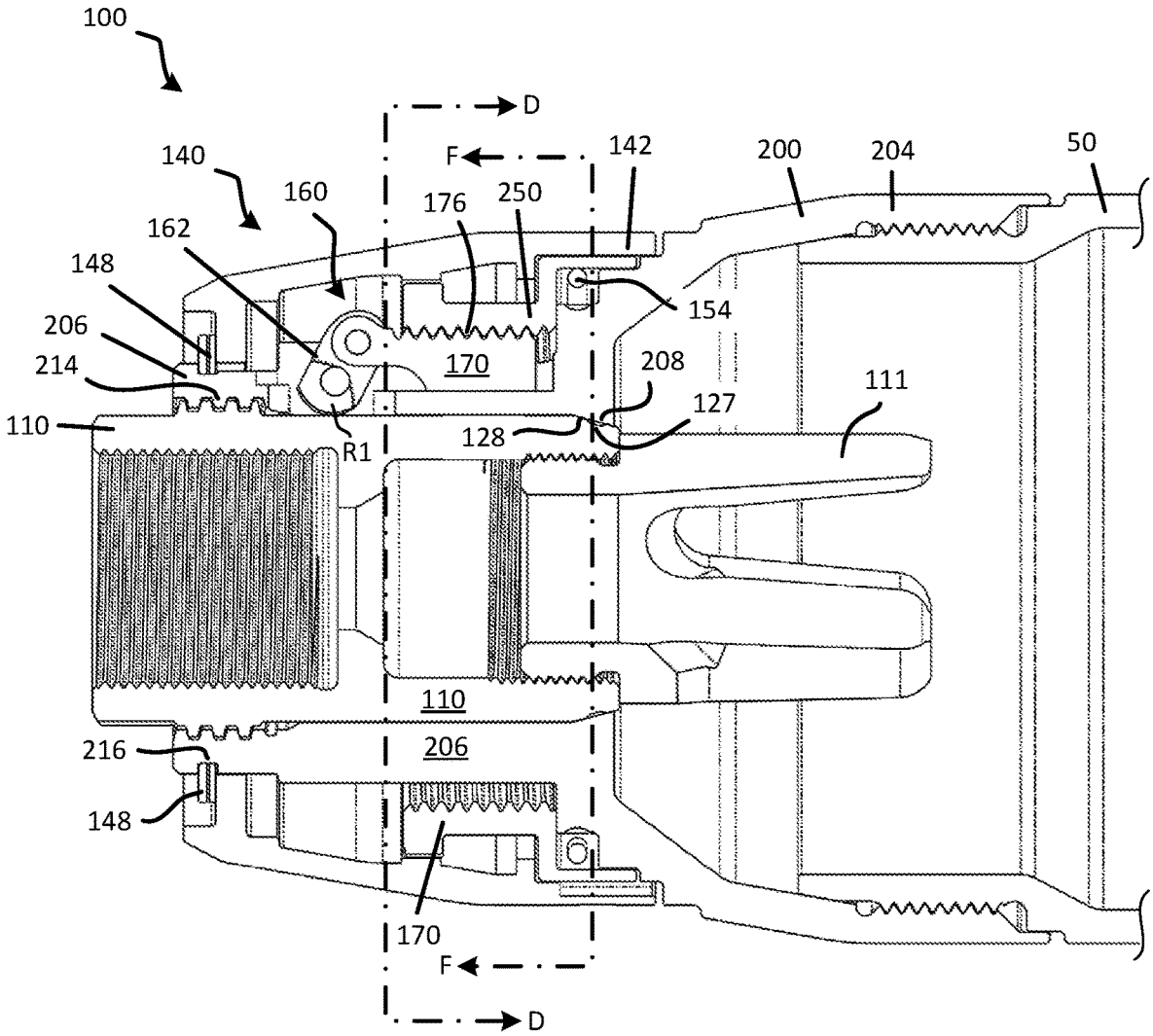
FIG. 11A illustrates a side view of longitudinal section of a mounting assembly in an unlocked position, in accordance with an embodiment of the present disclosure.
Figure 11B:
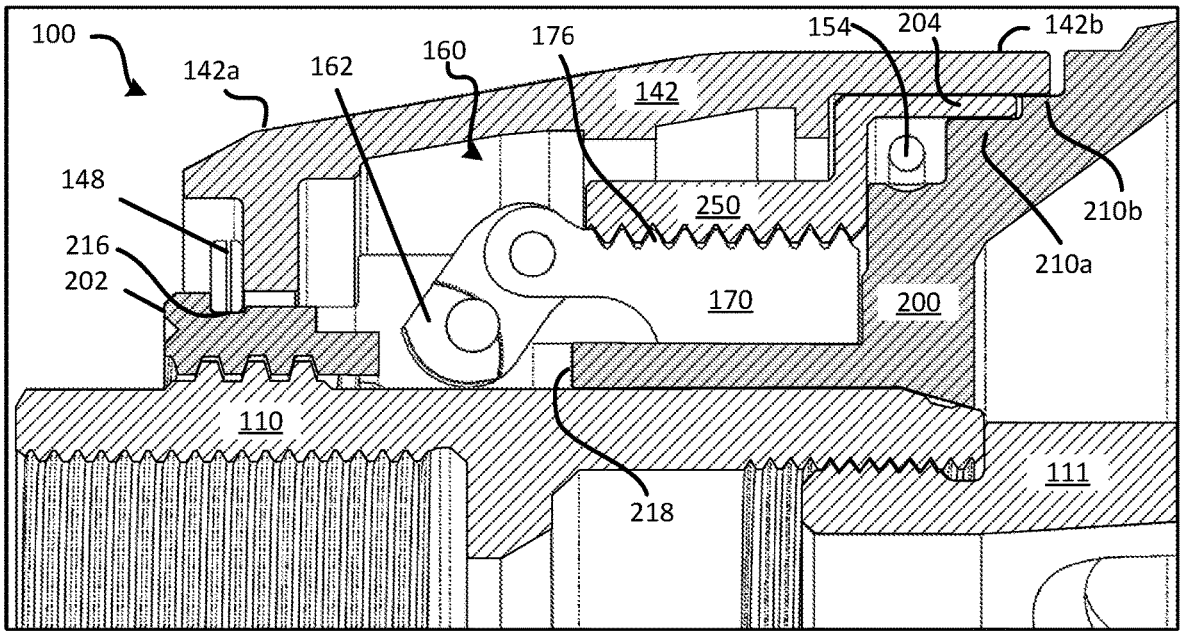
FIG. 11B illustrates a close-up view of part of the longitudinal section of FIG. 11A.

Referring now to FIG. 11A, a side view shows a longitudinal section of a mounting assembly 100 installed on a muzzle adapter 110, where the locking assembly 140 is in an unlocked state, in accordance with an embodiment of the present disclosure. FIG. 11B illustrates an enlarged side view showing part of the longitudinal section of the mounting assembly 100 of FIG. 11A. In this example, a flash hider 111 is attached to the muzzle adapter 110 and extends axially into the attachment mount 200. The attachment mount 200 is threadably secured at the mount distal end portion 204 to a suppressor 50 (shown in FIGS. 1A-1B). The attachment mount 200 also threadably engages the muzzle adapter 110 with threads 214 at the proximal end portion 206 and forms a seal with the muzzle adapter 110 between tapers 208 and 128. Note that the taper 128 on the muzzle adapter 110 has a circumferential groove 127 or break. The circumferential groove 127 can trap gases that leak through the taper seal.

Figure 11C:
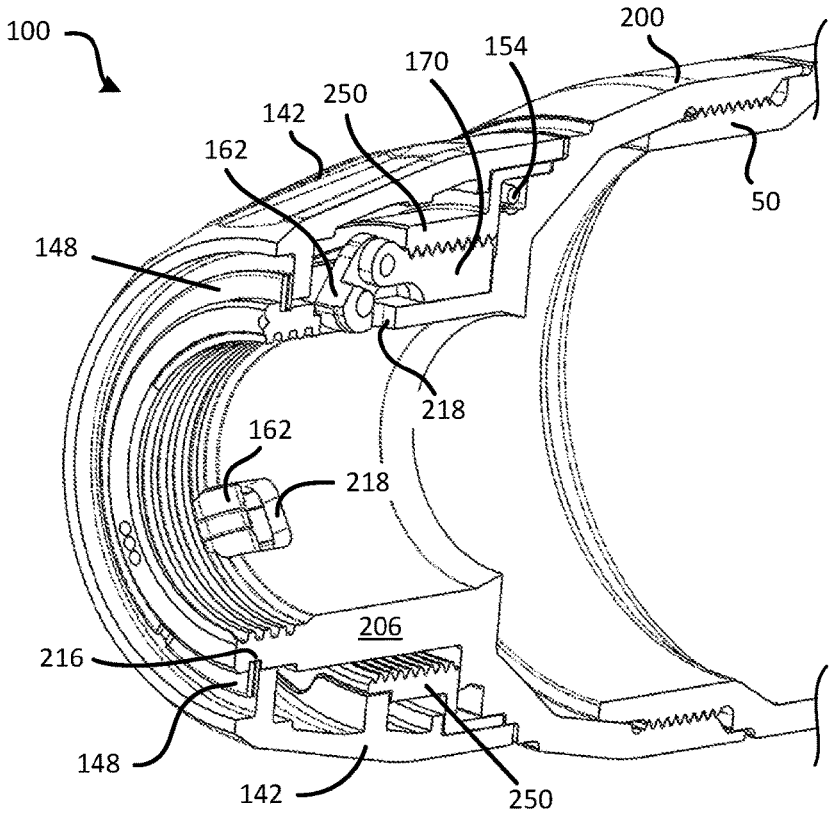
FIG. 11C is a rear perspective view showing a longitudinal section of a mounting assembly in an unlocked position and without a muzzle adapter, in accordance with an embodiment of the present disclosure.

With continued reference to FIGS. 11A-11B, FIG. 11C illustrates a rear perspective view showing the longitudinal section of the mounting assembly in an unlocked condition and without the muzzle adapter 110, in accordance with an embodiment. In these examples, the locking assembly 140 includes the locking nut 250, locking collar 142, and locking structure 160. The locking structure 160 includes cams 162 and racks 170 that are retained on the proximal end portion 206 of the attachment mount 200 using pins, as discussed above. In the unlocked state, the locking nut 250 has been rotated in a first rotational direction to advance the racks 170 distally, pivoting the cams 162 so that the portion of smaller radius R1 aligns with the muzzle adapter 110. In this position, the cams 162 are minimally engaged or are disengaged from the outside surface of the muzzle adapter 110, thereby allowing the locking nut 250 to rotate to a loosening position with respect to the muzzle adapter 110. Note that in this example, that all or most of the threads 176 on the rack 170 engage threads on the locking nut 250. In some embodiments, the rack 170 abuts or nearly abuts a radial wall of the attachment mount 200 when the locking structure 160 is in the unlocked position, such as shown in FIG. 11B. In the unlocked condition, the mounting assembly 100 can be installed on or removed from the muzzle adapter 110 by rotating the attachment mount 200 with respect to the muzzle adapter 110.

A retaining ring 148, such as a snap ring or split ring, is received in a circumferential groove 216 near the proximal end 202 of the attachment mount 200. The retaining ring 148 is trapped axially between the attachment mount 200 and the locking collar 142, blocking the locking collar 142 from being removed from the proximal end portion 206 of the attachment mount 200. At its distal end 142*b*, the locking collar 142 is prevented from moving forward in an axial direction by contact with the locking nut 250 and/or with a step 210 on the attachment mount 200. Thus, in accordance with some embodiments, the locking collar 142 and the locking nut 250 can rotate about the proximal end portion 206 of the attachment mount 200 without shifting axially. Instead, rotating the locking nut 250 causes racks 170 move axially, which can be performed by rotating the locking collar 142. Note that the locking collar 142 is not required for operation of the mounting assembly 100, but is provided as the means of preventing axial translation of the locking nut 250 during locking and unlocking, to protect the locking structure 160 from intrusion of dust and debris, and to block the locking structure 160 from damage due to contact with the user or other items. If the locking collar 142 is omitted, for example, the axial position of the locking nut 250 can be fixed using other methods.

In FIG. 11B, the distal end portion 204 of the locking nut 250 overlaps a first step 210*a* and the distal end 142*b* of the locking nut 250 overlaps a second step 210*b* of the attachment mount 200. The locking nut 250 and locking collar 142 can rotate about the axially extending portion of the respective step 210. In some embodiments, the distal end of the locking nut 250 and distal end 142*b* of the locking collar 142 have a consistent radial dimension (e.g., thickness) and align with the radially extending portion of the respective step 210.

Figure 11D:
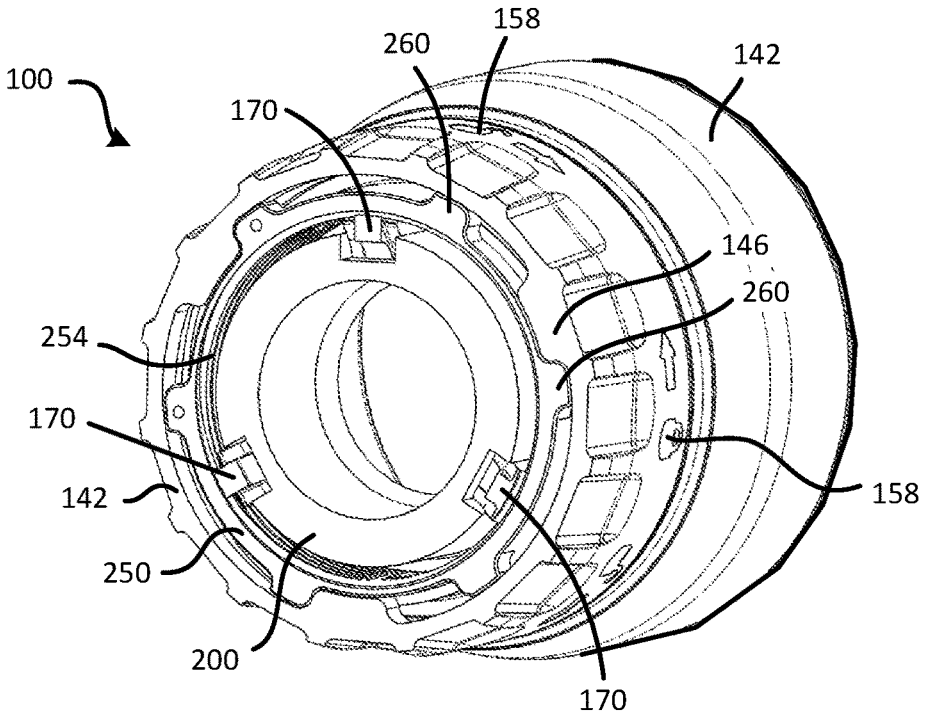
FIG. 11D illustrates a rear perspective, cross-sectional view of a mounting assembly in an unlocked position, in accordance with an embodiment of the present disclosure.
Figure 11E:
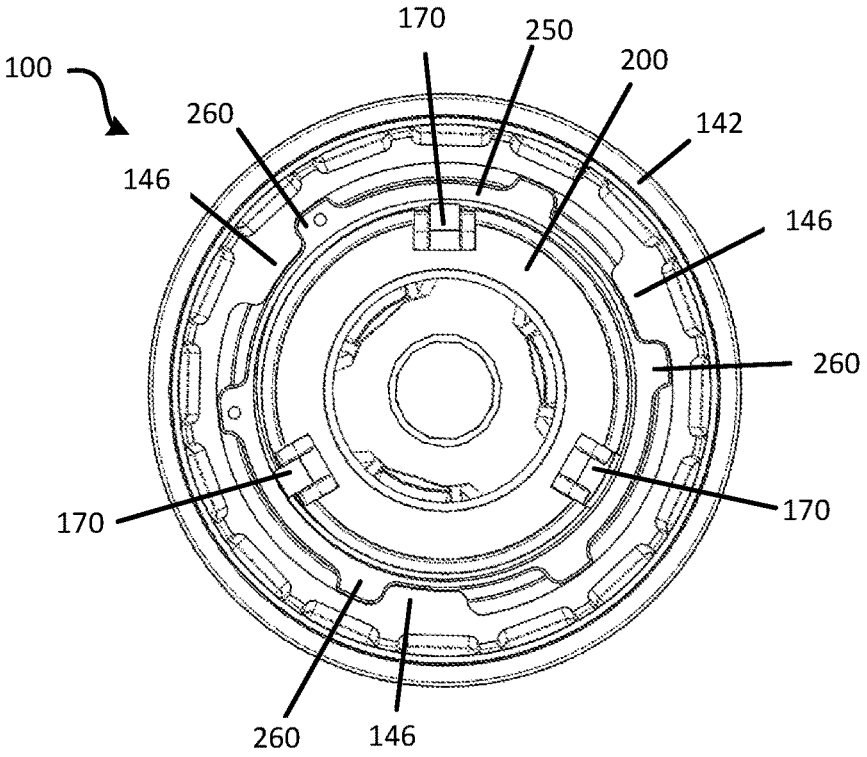
FIG. 11E illustrates a rear-end, cross-sectional view showing the mounting assembly in an unlocked position, in accordance with an embodiment of the present disclosure.

FIG. 11D illustrates a rear perspective, cross-sectional view taken along line D-D of FIG. 11A and FIG. 11E illustrates a rear-end, cross-sectional view taken along line D-D of FIG. 11A. FIGS. 11D and 11E show the mounting assembly 100 of FIG. 11A with the locking assembly 140 is in an unlocked position, in accordance with an embodiment. The locking collar 142 has been rotated in a first direction (clockwise as shown) so that the protrusions 146 extending radially inward from the locking collar 142 engage bosses 260 on the locking nut 250. As such, the locking collar 142 can be further rotated in the first direction in engagement with the locking nut 250 to advance the racks 170 distally and cause cams 162 to pivot to a disengaged position with respect to a muzzle adapter 110. As can be seen in FIG. 11D, for example, each rack 170 engages the threads 254 on the inside of the locking nut 250. The outside surface of the locking collar 142 includes indicia 158 to indicate to the user the direction of rotation to lock or unlock the mounting assembly 100.

Figure 11F:
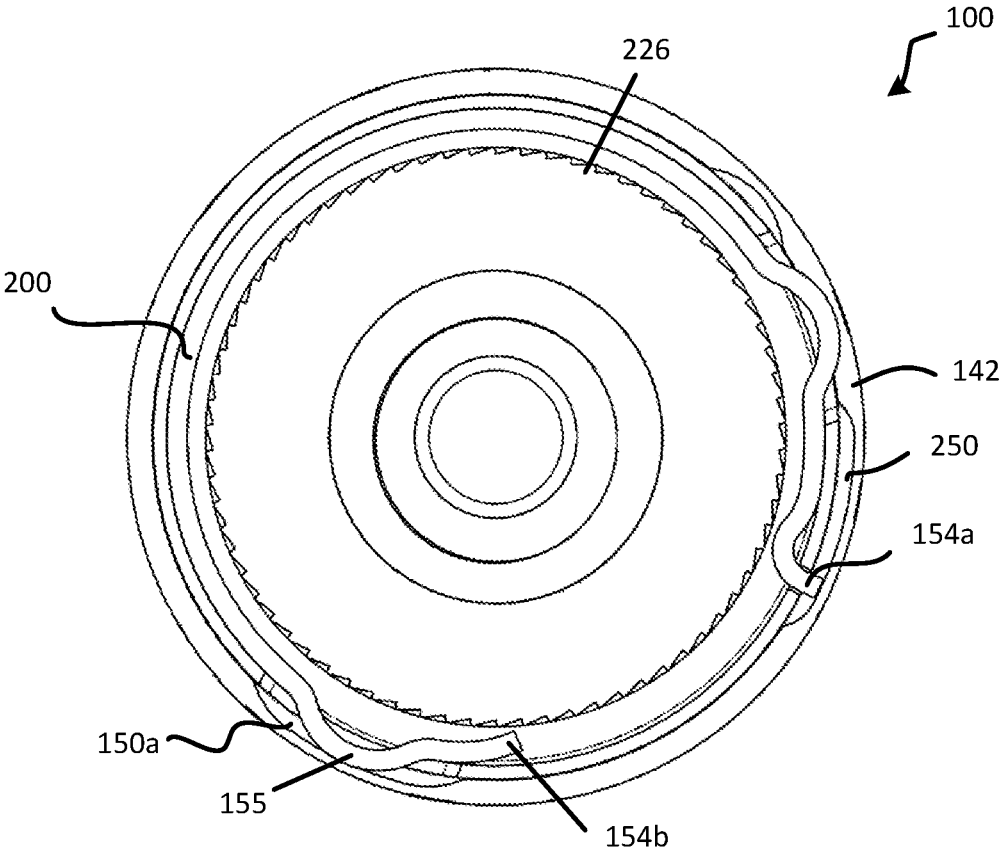
FIG. 11F illustrates a cross-sectional view showing a wire form and components of a mounting assembly in an unlocked position, in accordance with an embodiment of the present disclosure.

FIG. 11F, shows a cross-sectional view taken through the locking collar 142, locking nut 250, and attachment mount 200 at a location adjacent the recesses 226 encircling the outside of the attachment mount 200 as indicated by line F-F in FIG. 11A. The wire form 154 is radially between the attachment mount 200 and the locking nut 250 and extends circumferentially around a majority portion (e.g., about 70-85%) of the circumference of the locking nut 250. The first end 154*a* of the wire form 154 extends radially outward and is received in an elongated spring recess 150*a* defined in the locking collar 142. The second end 154*b* of the wire form 154 extends largely circumferentially and slightly radially inward towards recesses 226 on the attachment mount 200. Due, however, to the adjacent outward bend 155 being received in an elongated spring recess 150*a*, the second end 154*b* is positioned sufficiently radially outward so that it does not engage the recesses 226 on the outside of the attachment mount 200, owing to spring expansion in a radially outward direction. Another one of the outward bends 155 is received in a small recess 150*b*, providing a positive stop for the locking collar 142 being in the unlocking position where protrusions 146 and bosses 260 are engaged for rotating the locking nut 250 to an unlocked position.

Figure 12A:
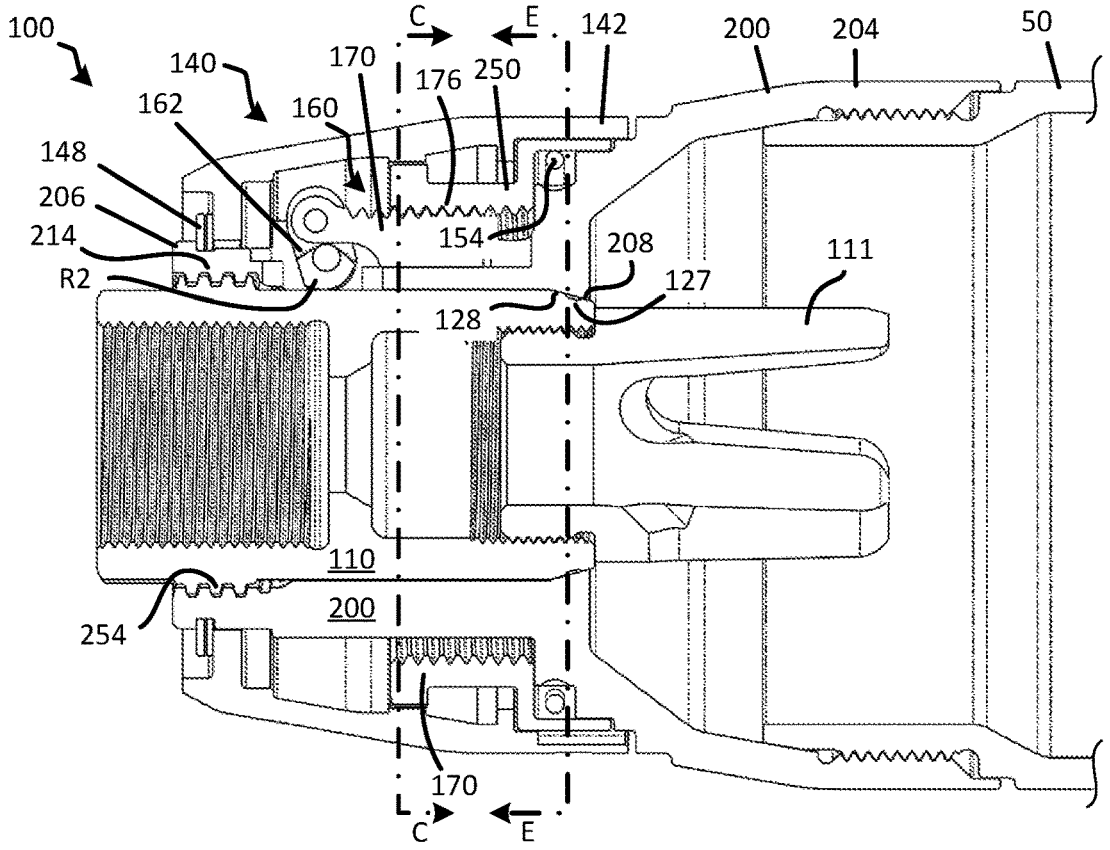
FIG. 12A illustrates a side view showing a longitudinal section of a mounting assembly in a locked position, in accordance with an embodiment of the present disclosure.
Figure 12B:
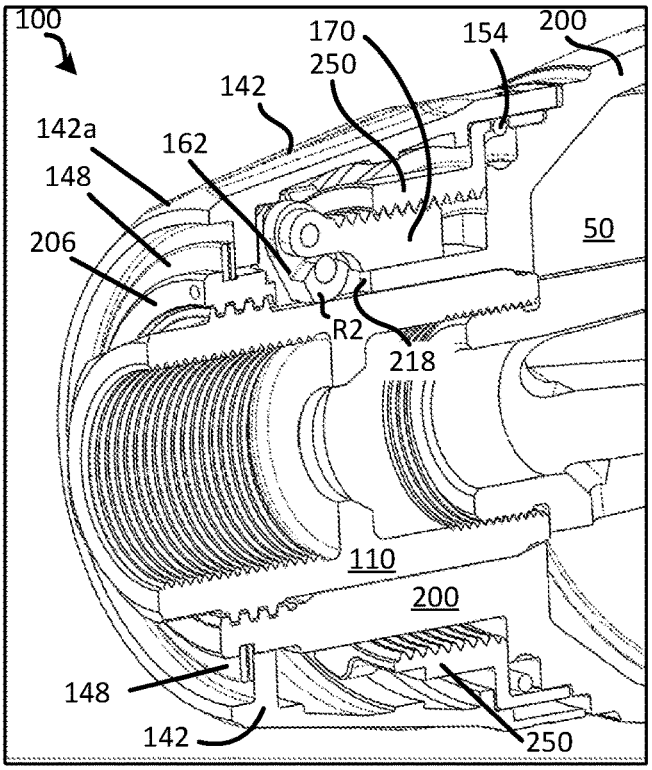
FIG. 12B illustrates a rear perspective view of part of the longitudinal section taken of FIG. 12A.
Figure 12C:
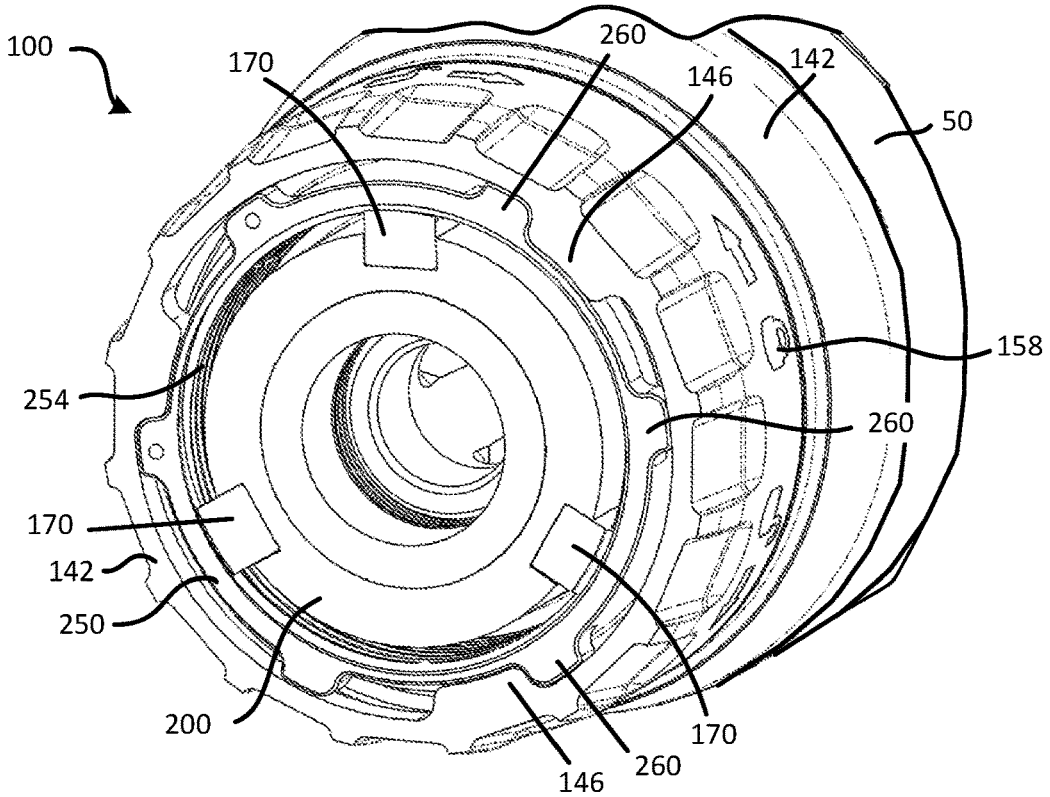
FIG. 12C illustrates a rear perspective, cross-sectional view of a mounting assembly in a locked position, in accordance with an embodiment of the present disclosure.
Figure 12D:
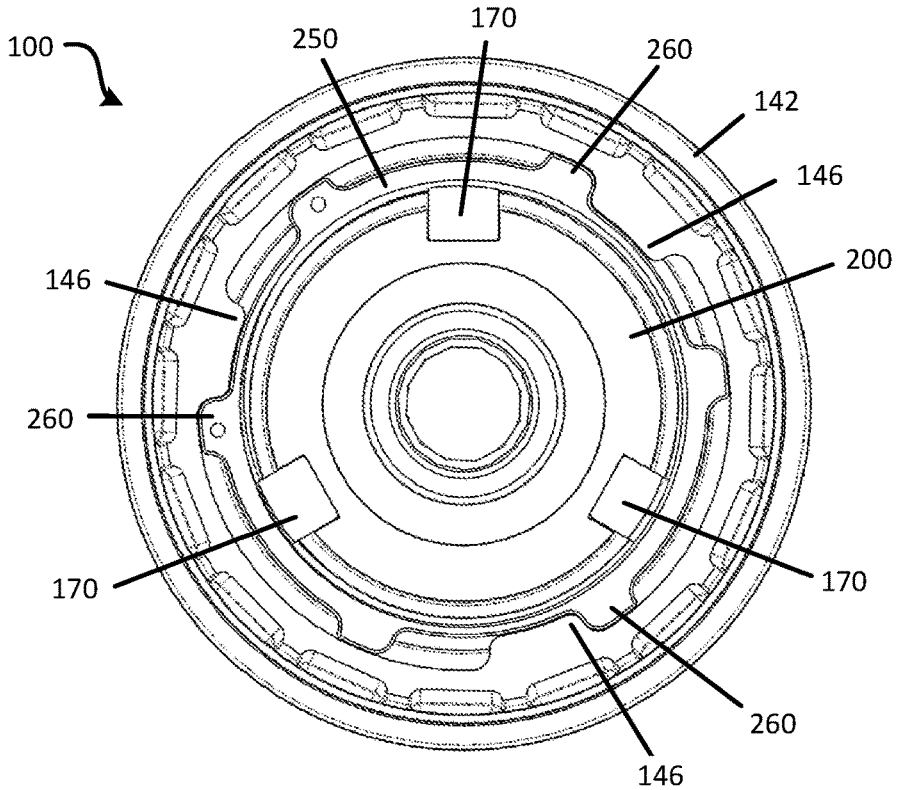
FIG. 12D illustrates a rear-end, cross-sectional view of a mounting assembly in a locked position, in accordance with an embodiment of the present disclosure.

Referring now to FIGS. 12A-12D, side and perspective views illustrate a mounting assembly 100 in a locked condition, in accordance with an embodiment of the present disclosure. FIG. 12A is a side view of a longitudinal section of a mounting assembly 100 installed on a muzzle adapter 110 and with the locking assembly 140 in a locked state; FIG. 12B is a rear perspective view showing part of the longitudinal section of FIG. 12A; FIG. 12C is a rear perspective, cross-sectional view of the mounting assembly 100; and FIG. 12D is a rear-end, cross-sectional view of the mounting assembly 100, where the sections of FIGS. 12C and 12D are taken along line C-C of FIG. 12A.

In this example, similar to that shown in FIG. 11A, a flash hider 111 is attached to the muzzle adapter 110 and extends axially into the attachment mount 200. The attachment mount 200 is threadably secured at its distal end portion 204 to a suppressor 50, a portion of which is shown. The proximal end portion 206 of the attachment mount 200 threadably engages the muzzle adapter 110 with threads 214. A seal is formed between taper 208 and taper 128 on the muzzle adapter 110. As discussed above, the taper 128 on the muzzle adapter 110 has a circumferential groove 127 or break; the circumferential groove 127 can additionally or alternately be a break in the taper 208 of the attachment mount 200.

The locking assembly 140 includes the locking nut 250, locking collar 142, and locking structure 160. The locking structure 160 includes cams 162 and racks 170 that are retained to the proximal end portion 206 of the attachment mount 200. In this example, the locking collar 142 and locking nut 250 have been rotated in a second rotational direction (counterclockwise as viewed looking at the proximal end) to advance the racks 170 rearward and thereby pivot the cams 162 to engage the outside surface of the muzzle adapter 110. With the portion of larger radius R2 of cams 162 engaging the muzzle adapter 110, the locking structure 160 inhibits rotating the attachment mount 200 on the muzzle adapter, such as to a loosened position. Note also in this example, that only some of the threads 176 on the rack 170 engage threads 254 on the locking nut 250 due to the more proximal position of the racks 170.

Referring to FIG. 12D, a rear end, cross-sectional view and shows the mounting assembly 100 in a locked position, in accordance with an embodiment. As noted above, the locking collar 142 has been rotated in a second rotational direction (counterclockwise as shown) so that the protrusions 146 extending radially inward from the locking collar 142 engage bosses 260 on the locking nut 250. As such, the locking collar 142 can be used to rotate the locking nut 250 in the second rotational direction as needed to advance the racks 170 proximally and to pivot cams 162 to an engaged position with respect to a muzzle adapter 110. As will be appreciated, the mounting assembly 100 can be configured to rotate in either direction to engage the locking structure 160 and in the opposite rotational direction to disengage the locking structure 160.

Figure 12E:
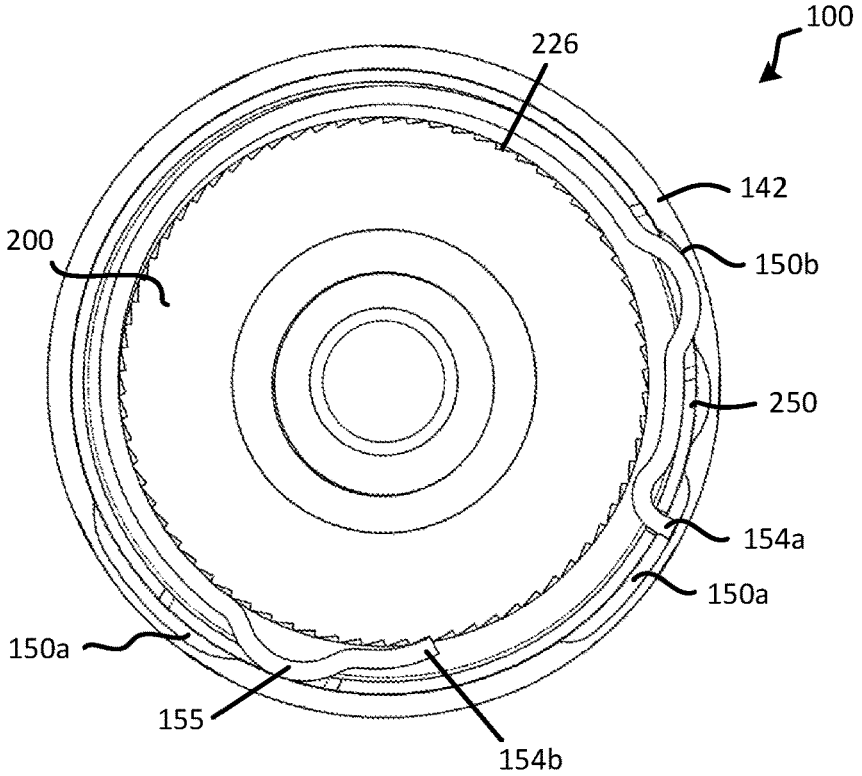
FIG. 12E illustrates a cross-sectional view showing a wire form and components of a mounting assembly in a locked position, in accordance with an embodiment of the present disclosure.

Referring to FIG. 12E, a front-end, cross-sectional view is illustrated as taken through line E-E of FIG. 12A at a location adjacent the recesses 226 encircling the outside of the attachment mount 200. The wire form 154 is radially between the attachment mount 200 and the locking nut 250 and extends circumferentially around a majority portion (e.g., about 70-85%) of the circumference of the locking nut 250. The first end 154*a* and outward bends 155 protrude through the locking nut 250 to be received in spring recesses 150 in the locking collar 142. The first end 154*a* extends radially outward through the locking nut 250 and is received in an elongated spring recess 150*a* defined along the inside of the locking collar 142. The second end 154*b* of the wire form 154 is inside of the locking nut 250 and extends largely circumferentially and slightly radially inward towards recesses 226 on the attachment mount 200. Due to the adjacent outward bend 155 contacting the inside of the locking collar 142, rather than being received in an elongated spring recess 150*a*, the second end 154*b* is deflected radially inward to engage the recesses 226 on the outside of the attachment mount 200. As such, when the locking collar 142 is rotated towards the locked position (clockwise as shown in FIG. 12E), the second end 154*b* moves across the recesses 226 to provide a click and/or tactile feedback to the user. Another one of the outward bends 155 adjacent the first end 154*a* is received in a small recess 150*b*, providing a positive stop for the locking collar 142 in the locking position.

Figure 12F:
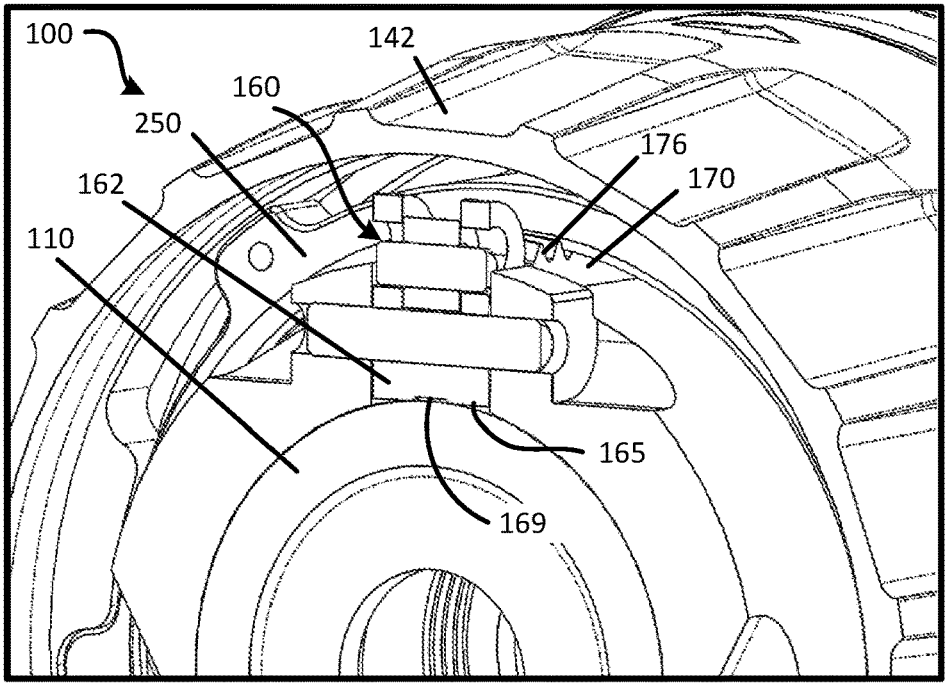
FIG. 12F illustrates a perspective view of a cross section through a mounting assembly and shows components of the locking assembly in a locked condition with a muzzle adapter, in accordance with an embodiment of the present disclosure.

FIG. 12F illustrates a rear perspective view showing a cross-section taken through the locking structure 160 in a locked position, in accordance with an embodiment of the present disclosure. The cam 162 can be seen engaging the outside surface of the muzzle adapter 110. Note that the cam surface 165 is relieved by defining a recess or groove 169. The groove 169 reduces the contact area and can improve the grip or "bite" of the cam 162 and the muzzle adapter 110 in some embodiments. Note also in this embodiment that part of the thread 176 of the rack 170 extends proximally beyond the locking nut 250, indicating that the rack 170 has been advanced axially to a locking position.

Figure 13:
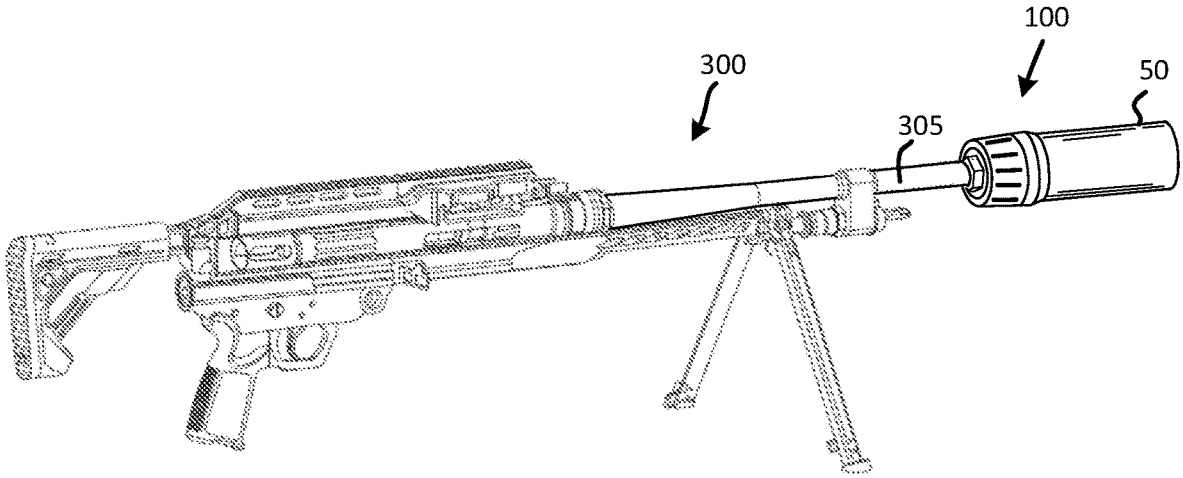
FIG. 13 is a perspective view of a machine gun with a suppressor mounted to the barrel using a toolless mounting assembly, in accordance with an embodiment of the present disclosure.

FIG. 13 illustrates a perspective view of a machine gun 300 with a suppressor 50 mounted to the barrel 305 using a toolless mounting assembly, in accordance with an embodiment of the present disclosure. The machine gun 300 can be a light, medium, or heavy machine gun configured for belt-fed or magazine-fed ammunition. Numerous variations and embodiments will be apparent in light of the present disclosure.

Figure 14:
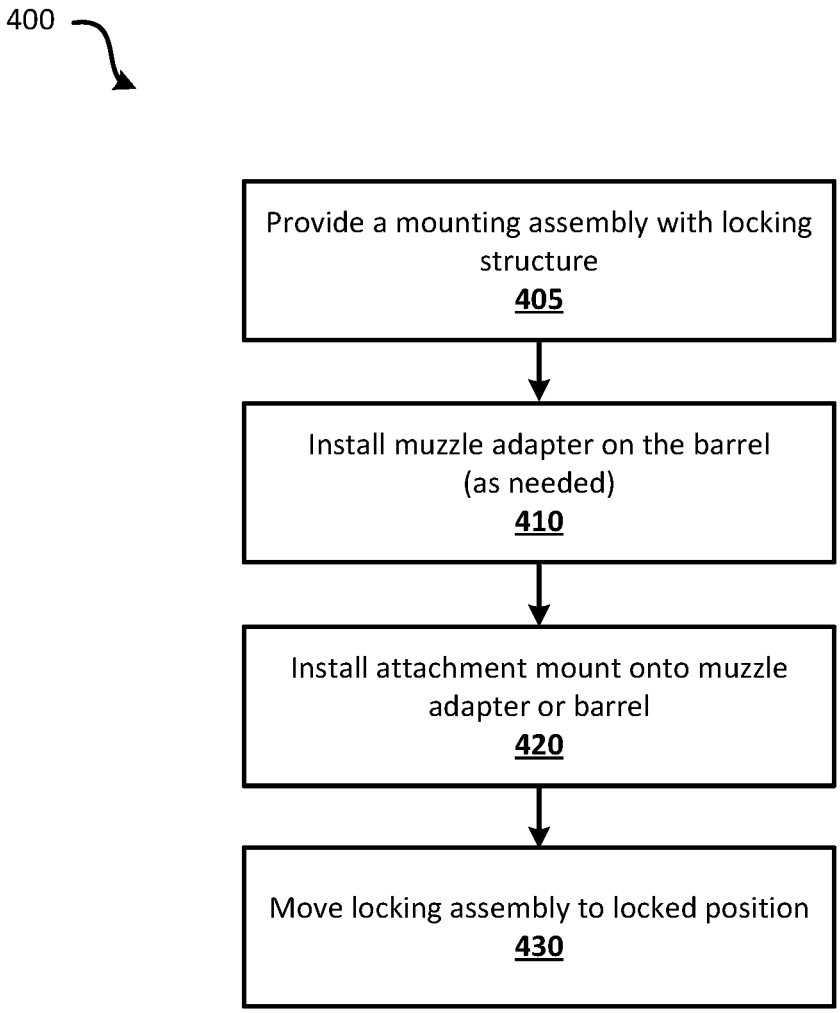
FIG. 14 illustrates steps in a method of installing a muzzle device on a firearm, in accordance with an embodiment of the present disclosure.

Referring now to FIG. 14, another aspect of the present disclosure is directed to a method 400 of installing and/or removing a muzzle device on/from the barrel of a firearm without the use of tools. FIG. 14 illustrates a flowchart showing steps in one embodiment of the method 400. Method 400 is discussed below for installing a muzzle device; however, steps of method 400 can be performed partially or completely in the reverse order to remove a muzzle device, as will be appreciated.

Method 400 includes providing 405 a mounting assembly for a muzzle device, such as a suppressor, where the mounting assembly includes an attachment mount configured to mount the muzzle device to a muzzle adapter or directly to a firearm barrel. The mounting assembly includes a locking assembly that engages the outside of the muzzle adapter or barrel when the mounting assembly is installed. For example, the mounting assembly is any of the embodiments of a mounting assembly as disclosed herein. In some embodiments, providing 405 the mounting assembly includes providing the muzzle adapter as part of the mounting assembly. Steps below are discussed in the context of installing the mounting assembly on a muzzle adapter; however, it is to be appreciated that a muzzle adapter is not required in all embodiments and that the mounting assembly can be mounted directly on a firearm barrel in some embodiments.

If a muzzle adapter is required and is not already present on the firearm, method 400 continues with installing 410 the muzzle adapter on the firearm barrel, such as by screwing the muzzle adapter onto the threaded end of the barrel. Other attachment methods are acceptable as will be appreciated. In some embodiments, installing 410 the muzzle adapter may include removing an existing muzzle adapter or muzzle device followed by installing a muzzle adapter sized for use with the mounting assembly.

Method 400 continues with attaching 420 the attachment mount to the muzzle adapter, such as by screwing the attachment mount onto the muzzle adapter. In some embodiments, attaching 420 the attachment mount includes forming a seal between the muzzle adapter and the attachment mount via mating tapers. In some embodiments, attaching 420 the attachment mount to the muzzle adapter includes first moving the mounting assembly to the unlocked position.

After installing the attachment mount on the muzzle adapter, method 400 continues with moving 430 the locking assembly to the locked position to engage a locking structure with the muzzle adapter. For example, moving the locking assembly to the locked position includes first rotating a locking collar in a first rotational direction to a locking position in which the locking collar contacts the locking nut. Subsequently, the locking collar can be further rotated in the first rotational direction to rotate the locking nut. In doing so, cams pivot to engage the outside surface of the muzzle adapter. In one such embodiment, rotating the locking nut in the first rotational advances the racks axially (e.g., proximally), which in turn pivots cams into engagement with the outside surface of the muzzle adapter. In some embodiments, moving 430 the locking assembly to the locked position is performed by rotating the locking collar and locking nut in the same rotational direction as threading the attachment mount onto the muzzle adapter.

Steps of method 400 can be performed largely in the reverse order to remove a muzzle device from the firearm barrel. To unlock the locking assembly, the locking collar is rotated in a second rotational direction from the locking position to an unlocking position in which the locking collar contacts a different surface of the locking nut. In doing so, the locking collar rotates without affecting the position of the locking nut. Subsequently, the locking collar can be further rotated in the second rotational direction to rotate the locking nut. In doing so, cams pivot to disengage from the outside surface of the muzzle adapter. In one such embodiment, rotating the locking nut in the second rotational direction advances the racks axially (e.g., distally), which in turn pivots cams out of engagement with the outside surface of the muzzle adapter.

In use, the mounting assembly 100 as variously described herein, can be used to install a muzzle device (e.g., a suppressor 50) and/or remove the muzzle device from a host firearm without the use of tools. In some embodiments, the firearm is a machine gun, such as a belt-fed machine gun chambered in 7.62×51 mm, 6.8×51 mm, 338 Norma Magnum, or other cartridges. Other host firearms and chambers can be used, as will be appreciated.

Various embodiments of the mounting assembly 100 can be constructed from any suitable material(s), as will be apparent in light of this disclosure. For example, some embodiments of the mounting assembly 100 (or individual components thereof) are constructed from AISI 4140 steel or from chromium- or austenitic nickel-chromium-based alloys, such as 17-4 Stainless Steel or Inconel alloy 625. It may be desirable in some instances for mounting assembly 100 to be constructed of a material that is corrosion resistant, retains strength over a large temperature range (e.g., in the range of about −50° F. to 1200° F.), and/or resistant to deformation and/or fracture at high pressures (e.g., 600-650 psi throughout and over 1000 psi in localized areas). In a more general sense, the mounting assembly 100 can be constructed from any suitable material which is compliant, for example, with United States Defense Standard MIL-W-13855 (Weapons: Small Arms and Aircraft Armament Subsystems, General Specification For). Other suitable materials for the mounting assembly 100 may depend on a given application and will be apparent in light of this disclosure.

Further Example Embodiments

The following examples pertain to further embodiments, from which numerous permutations and configurations will be apparent.

Example 1 is a toolless mounting assembly for firearm muzzle devices. In one embodiment, the mounting assembly includes an attachment mount extending along a central axis and having a mount proximal end portion and a mount distal end portion. The mount proximal end portion is configured to receive and releasably attach to a muzzle adapter or firearm muzzle and the distal end portion is configured to attach to a muzzle device, such as a suppressor. A locking mechanism is on the mount proximal end portion and includes one or more cams received in openings defined in the mount proximal end portion. The cams are movable between an engaged position and a disengaged position. In the engaged position, the cams are positioned to engage an outer surface of a muzzle or muzzle adapter installed in the proximal end portion of the attachment mount. A locking nut is rotatable about the mount proximal end portion, where rotating the locking nut in a first rotational direction moves the cams toward the engaged position and rotating the locking nut in a second rotational direction moves the cams towards the disengaged position.

Example 2 includes the subject matter of Example 1, where the locking nut defines threads on an inside surface, the locking mechanism further includes a rack movably connected to each of the cams where each rack has a body on an outside of the mount proximal end portion and defines threads engaging the threads on the inside surface of the locking nut, and rotating the locking nut about the mount proximal end portion moves each rack axially along the mount proximal end portion, thereby pivoting the respective one of the cams.

Example 3 includes the subject matter of Examples 1 or 2, where the locking mechanism preferably includes at least two cams on opposite sides of the mount proximal end portion, more preferably three or more cams distributed circumferentially around the mount proximal end portion.

Example 4 includes the subject matter of any one of Examples 1-3 and further includes a locking collar rotatable about the locking nut. An inside of the locking collar defines a lug configured to engage the locking nut when the locking collar is rotated in the first rotational direction or in the second rotational direction, so that the locking collar can be used to rotate the locking nut.

Example 5 includes the subject matter of Example 4 and further comprises a locking ring received in a recess in the mount proximal end portion. The locking ring is positioned to obstruct removal of the locking collar from the attachment mount in a proximal direction.

Example 6 includes the subject matter of any one of Examples 4 or 5, where the lug comprises protrusions extending radially inward from an inside of the locking collar and where the locking nut includes one or more bosses extending radially outward from an outside of the locking nut. At least one of the protrusions is aligned to engage at least one of the bosses when the locking collar rotates.

Example 7 includes the subject matter of any one of Examples 4-6 and further comprises a wire form disposed between the locking nut and the attachment mount, where part of the wire form engages a first part of the locking collar when the locking collar is in a first position relative to the locking nut and engages a second part of the locking collar when the locking collar is in a second position relative to the locking nut.

Example 8 includes the subject matter of Example 7, where the wire form defines an outward bend protruding through an opening in the locking nut, the outward bend received in a first recess on an inside of locking collar when the locking collar is in the first position and the outward bend is received in a second recess on an inside of the locking collar when the locking collar is in the second position.

Example 9 includes the subject matter of any one of Examples 7 or 8, where an end of the wire form contacts an outside of the attachment mount when the locking collar rotates in the first rotational direction to provide tactile and/or audible feedback to a user.

Example 10 includes the subject matter of any one of Examples 1-9, where the attachment mount defines a female tapered surface extending around an inside of the mount proximal end portion, the tapered surface defining a taper angle of at least 7° with respect to the central axis.

Example 11 includes the subject matter of Example 10, where the female taper includes a first portion and a second portion spaced apart by a circumferential groove.

Example 12 includes the subject matter of any one of Examples 1-11 and further comprises a muzzle adapter sized and configured to threadably engage threads on an inside of mount proximal end portion.

Example 13 includes the subject matter of Examples 10 or 11 and further comprises a muzzle adapter sized and configured to threadably engage threads on an inside of the mount proximal end portion. The muzzle adapter defines a male tapered surface around an outside of the distal end portion, where the male tapered surface engages the female tapered surface to form a seal when the muzzle adapter is installed in the mount proximal end portion.

Example 14 includes the subject matter of Example 13, where the male taper has a first taper portion and a second taper portion spaced apart by a circumferential groove.

Example 15 includes the subject matter of any one of Examples 12-14 and further comprises a flash hider secured to the muzzle adapter.

Example 16 includes the subject matter of Example 1-15 and further comprises a suppressor secured to a distal end portion of the attachment mount.

Example 17 is a firearm comprising the mounting assembly and suppressor of Example 16.

Example 18 includes the subject matter of Example 17, where the firearm is a machine gun.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A mounting assembly for a firearm muzzle device, the mounting assembly comprising:

an attachment mount extending along a central axis and having a mount proximal end portion and a mount distal end portion, the mount proximal end portion configured to receive and releasably attach to a muzzle adapter or firearm muzzle;

a locking mechanism on the mount proximal end portion, the locking mechanism having one or more cams received in openings defined in the mount proximal end portion, the one or more cams movable between an engaged position and a disengaged position, wherein in the engaged position, the one or more cams are positioned to engage an outer surface of a muzzle or muzzle adapter installed in the mount proximal end portion; and a locking nut rotatable about the mount proximal end portion, wherein rotating the locking nut in a first rotational direction moves the cams toward the engaged position and rotating the locking nut in a second rotational direction moves the cams towards the disengaged position, wherein the locking nut defines threads on an inside surface and the locking mechanism further includes a rack movably connected to each of the one or more cams, the rack having a body on an outside of the mount proximal end portion and defining threads engaging the threads on the inside surface of the locking nut; and wherein rotating the locking nut about the mount proximal end portion moves each rack axially along the mount proximal end portion, thereby pivoting the one or more cams.

2. The mounting assembly of claim 1, wherein the locking mechanism comprises at least two cams.

3. The mounting assembly of any one claim 1, wherein the attachment mount defines a female tapered surface extending around an inside of the mount proximal end portion, the female tapered surface defining a taper angle of at least 7° with respect to the central axis.

4. The mounting assembly of claim 3, wherein the female tapered surface includes a first portion and a second portion spaced apart axially by a circumferential groove.

5. The mounting assembly of claim 3, further comprising a muzzle adapter sized and configured to threadably engage threads on an inside of the mount proximal end portion, wherein the muzzle adapter defines a male tapered surface around an outside of the distal end portion, wherein the male tapered surface engages the female tapered surface to form a seal when the muzzle adapter is installed in the mount proximal end portion.

6. The mounting assembly of claim 5, wherein the male tapered surface has a first taper portion spaced from a second taper portion by a circumferential groove.

7. The mounting assembly of claim 1, further comprising a muzzle adapter sized and configured to threadably engage threads on an inside of mount proximal end portion.

8. The mounting assembly of claim 7, further comprising a flash hider secured to the muzzle adapter.

9. The mounting assembly of claim 7, further comprising a suppressor secured to a distal end portion of the attachment mount.

10. A firearm comprising the mounting assembly of claim 9.

11. The firearm of claim 10, wherein the firearm is a machine gun.

12. A mounting assembly for a firearm muzzle device, the mounting assembly comprising:

an attachment mount extending along a central axis and having a mount proximal end portion and a mount distal end portion, the mount proximal end portion configured to receive and releasably attach to a muzzle adapter or firearm muzzle;

a locking mechanism on the mount proximal end portion, the locking mechanism having one or more cams received in openings defined in the mount proximal end portion, the one or more cams movable between an engaged position and a disengaged position, wherein in the engaged position, the one or more cams are positioned to engage an outer surface of a muzzle or muzzle adapter installed in the mount proximal end portion;

a locking nut rotatable about the mount proximal end portion, wherein rotating the locking nut in a first rotational direction moves the cams toward the engaged position and rotating the locking nut in a second rotational direction moves the cams towards the disengaged position; and a locking collar rotatable about the locking nut, an inside of the locking collar defining a lug configured to engage the locking nut when the locking collar is rotated in the first rotational direction or in the second rotational direction, thereby rotating the locking nut.

13. The mounting assembly of claim 12, further comprising a locking ring received in a recess defined in the mount proximal end portion and positioned to obstruct removal of the locking collar from the attachment mount in a proximal direction.

14. The mounting assembly of claim 13, wherein the lug comprises protrusions extending radially inward from an inside of the locking collar and wherein the locking nut includes one or more bosses extending radially outward from an outside of the locking nut, at least one of the protrusions aligned to engage at least one of the one or more bosses when the locking collar rotates.

15. The mounting assembly of claim 12, further comprising a wire form between the locking nut and the attachment mount, wherein part of the wire form engages a first part of the locking collar when the locking collar is in a first position relative to the locking nut, and the wire form engages a second part of the locking collar when the locking collar is in a second position relative to the locking nut.

16. The mounting assembly of claim 15, wherein the wire form defines an outward bend protruding through an opening in the locking nut, the outward bend received in a first recess on an inside of locking collar when the locking collar is in the first position and the outward bend is received in a second recess on an inside of the locking collar when the locking collar is in the second position.

17. The mounting assembly of claim 16, wherein an end of the wire form contacts an outside of the attachment mount when the locking collar rotates in the first rotational direction to provide tactile and/or audible feedback to a user.

* * * * *